US007218300B2

(12) United States Patent
Shimizu

(10) Patent No.: US 7,218,300 B2
(45) Date of Patent: May 15, 2007

(54) LIQUID CRYSTAL DISPLAY AND METHOD OF DRIVING LIQUID CRYSTAL DISPLAY

(75) Inventor: Shigeo Shimizu, Yokohama (JP)

(73) Assignee: Victor Company of Japan, Ltd. (JP)

( * ) Notice: Subject to any disclaimer, the term of this patent is extended or adjusted under 35 U.S.C. 154(b) by 648 days.

(21) Appl. No.: 10/791,040

(22) Filed: Mar. 2, 2004

(65) Prior Publication Data

US 2004/0196233 A1 Oct. 7, 2004

(30) Foreign Application Priority Data

Mar. 3, 2003 (JP) ..... 2003-056280
Apr. 14, 2003 (JP) ..... 2003-109599
Apr. 14, 2003 (JP) ..... 2003-109600

(51) Int. Cl.
*G09G 3/36* (2006.01)

(52) U.S. Cl. ..... 345/87; 345/204

(58) Field of Classification Search ..... 345/87–100, 345/204

See application file for complete search history.

(56) References Cited

U.S. PATENT DOCUMENTS 5,253,074 A 10/1993 Wortel et al. ..... 358/236
6,052,166 A * 4/2000 Chikazawa ..... 349/116
RE37,056 E 2/2001 Wortel et al. ..... 248/761
7,084,861 B2 * 8/2006 Iisaka ..... 345/204
7,113,153 B2 * 9/2006 Kubota et al. ..... 345/60

FOREIGN PATENT DOCUMENTS

JP 08-101372 4/1996
JP 09-269479 10/1997
JP 11-174410 7/1999
JP 2001-343950 12/2001

* cited by examiner

*Primary Examiner*—Richard Hjerpe
*Assistant Examiner*—Jean Lesperance
(74) *Attorney, Agent, or Firm*—Renner, Kenner, Greive, Bobak, Taylor & Weber

(57) ABSTRACT

A liquid crystal display including a liquid-crystal display unit having a matrix of multiple pixels. A field of a digital input video signal to be supplied to the liquid-crystal display unit is divided into a plurality of subfields. The voltage of the digital video signal is adjusted per subfield to compensate for change in gamma characteristics of the liquid-crystal display unit. Instead of the voltage, the period of at least one subfield of the video signal can be adjusted for compensating for change in the gamma characteristics of the liquid-crystal display unit.

24 Claims, 15 Drawing Sheets

| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
|---|---|---|---|---|---|---|---|---|---|---|---|---|---|---|---|---|---|---|---|
| SUBFIELD PERIOD (μsec) | 30 | 60 | 90 | 110 | 130 | 150 | 170 | 190 | 205 | 220 | 235 | 250 | 260 | 270 | 280 | 290 | 295 | 300 | 305 |
| GRADATION LEVEL | | | | | | | | | | | | | | | | | | | |
| (PURE BLACK) 0 | | | | | | | | | | | | | | | | | | | |
| 1 | | | | | | | | | 1 | | | | | | | | | | |
| 2 | | | | | | | | | | | | | | | | | | | 1 |
| 3 | | | | 1 | | | | | | | | | | | | | | | 1 |
| 4 | | | | | | | | | 1 | | | | | | | | | | 1 |
| 5 | | | | | | | | | | | | | | 1 | | | | | 1 |
| 6 | | | | | | | | | | | | | | | | | | 1 | 1 |
| ⎫ | | | | | | | | | | | | | | | | | | | |
| 10 | | | | | | | | 1 | | | | | | | | | | 1 | 1 |
| ⎬ | | | | | | | | | | | | | | | | | | | |
| ⎭ | | | | | | | | | | | | | | | | | | | |
| 20 | | | | | | | | | | | | | | | | | 1 | 1 | 1 |
| 21 | 1 | | | | | | | | | | | | | | | | 1 | 1 | 1 |
| 22 | | 1 | | | | | | | | | | | | | | | 1 | 1 | 1 |
| 23 | | | 1 | | | | | | | | | | | | | | 1 | 1 | 1 |
| 24 | | | | 1 | | | | | | | | | | | | | 1 | 1 | 1 |
| 25 | | | | | 1 | | | | | | | | | | | | 1 | 1 | 1 |
| 26 | | | | | | 1 | | | | | | | | | | | 1 | 1 | 1 |
| 27 | | | | | | | 1 | | | | | | | | | | 1 | 1 | 1 |
| 28 | | | | | | | | 1 | | | | | | | | | 1 | 1 | 1 |
| 29 | | | | | | | | | 1 | | | | | | | | 1 | 1 | 1 |
| 30 | | | | | | | | | | 1 | | | | | | | 1 | 1 | 1 |
| 31 | | | | | | | | | | | 1 | | | | | | 1 | 1 | 1 |
| 32 | | | | | | | | | | | | 1 | | | | | 1 | 1 | 1 |
| 33 | | | | | | | | | | | | | 1 | | | | 1 | 1 | 1 |
| 34 | | | | | | | | | | | | | | 1 | | | 1 | 1 | 1 |
| 35 | | | | | | | | | | | | | | | 1 | | 1 | 1 | 1 |
| 36 | | | | | | | | | | | | | | | | 1 | 1 | 1 | 1 |
| 37 | 1 | | | | | | | | | | | | | | | 1 | 1 | 1 | 1 |
| ⎫ | | | | | | | | | | | | | | | | | | | |
| 100 | | | | | | | | | | | | | 1 | 1 | 1 | 1 | 1 | 1 | 1 |
| ⎬ | | | | | | | | | | | | | | | | | | | |
| ⎭ | | | | | | | | | | | | | | | | | | | |
| 200 | | | | | | 1 | 1 | 1 | 1 | 1 | 1 | 1 | 1 | 1 | 1 | 1 | 1 | 1 | 1 |
| ⎫ | | | | | | | | | | | | | | | | | | | |
| ⎭ | | | | | | | | | | | | | | | | | | | |
| (PURE WHITE) 255 | 1 | 1 | 1 | 1 | 1 | 1 | 1 | 1 | 1 | 1 | 1 | 1 | 1 | 1 | 1 | 1 | 1 | 1 | 1 |

FIG. 3

| SUBFIELD-PERIOD DIFFERENCE | 30 | 30 | 20 | 20 | 20 | 20 | 20 | 15 | 15 | 15 | 15 | 10 | 10 | 10 | 10 | 5 | 5 | 5 |
|---|---|---|---|---|---|---|---|---|---|---|---|---|---|---|---|---|---|---|
| SUBFIELD | SF1 | SF2 | SF3 | SF4 | SF5 | SF6 | SF7 | SF8 | SF9 | SF10 | SF11 | SF12 | SF13 | SF14 | SF15 | SF16 | SF17 | SF18 | SF19 |
| SUBFIELD PERIOD (μsec) | 30 | 60 | 90 | 110 | 130 | 150 | 170 | 190 | 205 | 220 | 235 | 250 | 260 | 270 | 280 | 290 | 295 | 300 | 305 |
| GRADATION LEVEL | | | | | | | | | | | | | | | | | | | |
| (PURE BLACK) 0 | | | | | | | | | | | | | | | | | | | |
| 1 | | | | | | | | | 1 | | | | | | | | | | |
| 2 | | | | | | | | | | | | | | | | | | | 1 |
| 3 | | | | 1 | | | | | | | | | | | | | | | 1 |
| 4 | | | | | | | | | 1 | | | | | | | | | | 1 |
| 5 | | | | | | | | | | | | | | 1 | | | | | 1 |
| 6 | | | | | | | | | | | | | | | | | | 1 | 1 |
| ∫ | | | | | | | | | | | | | | | | | | | |
| 10 | | | | | | | | 1 | | | | | | | | | | 1 | 1 |
| ∫ | | | | | | | | | | | | | | | | | | | |
| ∫ | | | | | | | | | | | | | | | | | | | |
| 20 | | | | | | | | | | | | | | | | | 1 | 1 | 1 |
| 21 | 1 | | | | | | | | | | | | | | | | 1 | 1 | 1 |
| 22 | | 1 | | | | | | | | | | | | | | | 1 | 1 | 1 |
| 23 | | | 1 | | | | | | | | | | | | | | 1 | 1 | 1 |
| 24 | | | | 1 | | | | | | | | | | | | | 1 | 1 | 1 |
| 25 | | | | | 1 | | | | | | | | | | | | 1 | 1 | 1 |
| 26 | | | | | | 1 | | | | | | | | | | | 1 | 1 | 1 |
| 27 | | | | | | | 1 | | | | | | | | | | 1 | 1 | 1 |
| 28 | | | | | | | | 1 | | | | | | | | | 1 | 1 | 1 |
| 29 | | | | | | | | | 1 | | | | | | | | 1 | 1 | 1 |
| 30 | | | | | | | | | | 1 | | | | | | | 1 | 1 | 1 |
| 31 | | | | | | | | | | | 1 | | | | | | 1 | 1 | 1 |
| 32 | | | | | | | | | | | | 1 | | | | | 1 | 1 | 1 |
| 33 | | | | | | | | | | | | | 1 | | | | 1 | 1 | 1 |
| 34 | | | | | | | | | | | | | | 1 | | | 1 | 1 | 1 |
| 35 | | | | | | | | | | | | | | | 1 | | 1 | 1 | 1 |
| 36 | | | | | | | | | | | | | | | | 1 | 1 | 1 | 1 |
| 37 | 1 | | | | | | | | | | | | | | | 1 | 1 | 1 | 1 |
| ∫ | | | | | | | | | | | | | | | | | | | |
| 100 | | | | | | | | | | | | | 1 | 1 | 1 | 1 | 1 | 1 | 1 |
| ∫ | | | | | | | | | | | | | | | | | | | |
| 200 | | | | | | 1 | 1 | 1 | 1 | 1 | 1 | 1 | 1 | 1 | 1 | 1 | 1 | 1 | 1 |
| ∫ | | | | | | | | | | | | | | | | | | | |
| (PURE WHITE) 255 | 1 | 1 | 1 | 1 | 1 | 1 | 1 | 1 | 1 | 1 | 1 | 1 | 1 | 1 | 1 | 1 | 1 | 1 | 1 |

FIG. 11

LIQUID CRYSTAL DISPLAY AND METHOD OF DRIVING LIQUID CRYSTAL DISPLAY

BACKGROUND OF THE INVENTION

The present invention relates to an active-matrix liquid crystal display driven by digital signals.

Active-matrix displays are usually driven by analog signals that control drive voltages for liquid crystals, such as, disclosed in Japanese Unexamined Patent Publication No. 11-174410 (1999).

There are several modes for liquid crystals, such as VA (Vertical Aligned) and MTN (Mixed-Mode Twisted Nematic). Particularly, VA is used for achieving high contrast ratio.

Active-matrix displays have multiple pixels formed with a liquid crystal filled between an active-matrix substrate and another substrate facing the former substrate. A signal supplied to each pixel is stored in a capacitor provided for the pixel, to drive the liquid crystal.

This type of active-matrix display provides enhanced gradation with voltages supplied to the liquid crystal constant for one-field period but varying in accordance with the level of video signals. Nevertheless, this type of display is prone to generation of noises on the video signals and effects of pseudo video signals, with D. C. components being easily applied to the liquid crystal to cause residual images, thus shorting the life of a display panel.

Another type of active-matrix display is driven by digital signals converted from analog video signals. Pulse voltages are applied to liquid crystals so that the liquid crystals are turned on or off per subfield of several subfields into which one field (one TV field) is divided. Known driving techniques are, such as, using weighted subfields, intra-field dispersion and CLEAR (Hi-Contrast and Low Energy Address and Reduction of False Contour Sequence), such as, disclosed in Japanese Unexamined Patent Publication No. 2001-343950.

This type of active-matrix display is driven by, for example, 8-bit digital signals converted from analog video signals based on CRT reverse-gamma characteristics. In detail, the analog video signals are converted into digital signals based on data stored in a look-up table for weighting corresponding to the gamma characteristics to provide correct gradation levels, due to S-shaped output-light intensity v. s. liquid-crystal driving voltage characteristics.

The digital-based drive technique explained above, causes variation in the gamma characteristics, such as, shown in FIG. 1, when the response speed of liquid crystals varies.

Shown in FIG. 1 is temperature dependency of the gamma characteristics per bit of 256 bits (gradation) in which the gamma characteristics (output light ratio) exhibits "1" at 40.7° C. in temperature and 0.08 Pa·s (Pascal second) in viscosity of liquid crystals.

The viscosity and temperature of liquid crystals have a (strong) correlation, for example, the viscosity becomes low as the temperature rises. In FIG. 1, the viscosity varies from 0.15 to 0.05 Pa·s while the temperature varies from 34.1 to 50.4° C.

It is revealed from FIG. 1 that change in output light at gradation levels is larger in the range from 50 to 100 bits, the intermediate gradation in 256 gradation levels (8 bits/monochrome color). The change in output light occurs due to change in response of liquid crystals to input pulses caused by change in physicality of the liquid crystals when the temperature varies. Several factors cause the change in physicality of liquid crystals, such as, reflectivity, dielectric constant, elastic coefficient, and viscosity of the liquid crystals. Among them, the viscosity is the major factor.

The curves shown in FIG. 1 were given by driving the liquid crystals with pulses shorter than the response time of the liquid crystals.

Higher response speed of liquid crystals provides larger output thanks to higher followability to a single driving pulse shorter than the response time of liquid crystals whereas lower output due to faster response of the liquid crystals to a no-voltage application periods between pulses of a plurality of such single driving pulses.

In contrast, lower response speed of liquid crystals provides lower output due to lower followability to a single driving pulse shorter than the response time of liquid crystals whereas higher output due to slower response of the liquid crystals to a no-voltage application periods between pulses of a plurality of such single driving pulses.

The change in response speed of liquid crystals is one of the factors of the variation in the gamma characteristics in the intermediate gradation. The variation in the gamma characteristics cannot be compensated for, only, by increasing or decreasing the output, because it is a non-linear variation, hence no feasible compensation techniques being proposed.

SUMMARY OF THE INVENTION

A purpose of the present invention is to provide a liquid crystal display and a method of driving a liquid crystal display in which the variation in the gamma characteristics of a liquid-crystal display unit can be compensated for against change in temperature.

Another purpose of the present invention is to provide a liquid crystal display and a method of a liquid crystal display that provide images of stable quality by controlling the temperature of a liquid-crystal display unit.

The present invention provides a liquid crystal display including a liquid-crystal display unit having a matrix of multiple pixels comprising: a divider to divide a field of a digital input video signal to be supplied to the liquid-crystal display unit into a plurality of subfields; and an adjuster to adjust a voltage of the digital video signal per subfield to compensate for change in gamma characteristics of the liquid-crystal display unit.

Moreover, the present invention provides a liquid crystal display including a liquid-crystal display unit having a matrix of multiple pixels comprising: a divider to divide a field of a digital input video signal to be supplied to the liquid-crystal display unit into a plurality of subfields; and an adjuster to adjust a period of at least one subfield of the video signal to compensate for change in gamma characteristics of the liquid-crystal display unit.

Furthermore, the present invention provides a liquid crystal display including a liquid-crystal display unit having a matrix of multiple pixels comprising: a detector to detect a temperature of the liquid-crystal display unit; and an adjuster to adjust the temperature of the liquid-crystal display unit to a given temperature in response to the detected temperature to compensate for a temperature-dependent change in gamma characteristics of the liquid-crystal display unit.

Still Furthermore, the present invention provides a color liquid crystal display including spatial light modulators for colors red, green and blue comprising: a detector to detect a temperature of each spatial light modulator; and an adjuster to adjust the temperature of each spatial light modulator to a given temperature or within a given temperature range in response to the detected temperature to compensate for a temperature-dependent change in gamma characteristics of the spatial light modulators.

Moreover, the present invention provides a method of driving a liquid crystal display including a liquid-crystal display unit having a matrix of multiple pixels comprising the steps of: dividing a field of a digital input video signal to be supplied to the liquid-crystal display unit into a plurality of subfields; and adjusting a voltage of the digital video signal per subfield to compensate for change in gamma characteristics of the liquid-crystal display unit.

Furthermore, the present invention provides a method of driving a liquid crystal display including a liquid-crystal display unit having a matrix of multiple pixels comprising the steps of: dividing a field of a digital input video signal to be supplied to the liquid-crystal display unit into a plurality of subfields; and adjusting a period of at least one subfield of the video signal to compensate for change in gamma characteristics of the liquid-crystal display unit.

Still furthermore, the present invention provides a method of driving a liquid crystal display including a liquid-crystal display unit having a matrix of multiple pixels comprising the steps of: detecting a temperature of the liquid-crystal display unit; and adjusting the temperature of the liquid-crystal display unit to a given temperature in response to the detected temperature to compensate for a temperature-dependent change in gamma characteristics of the liquid-crystal display unit.

Moreover, the present invention provides a method of driving a color liquid crystal display including spatial light modulators for colors red, green and blue comprising the steps of: detecting a temperature of each spatial light modulator; and adjusting the temperature of each spatial light modulator to a given temperature or within a given temperature range in response to the detected temperature to compensate for a temperature-dependent change in gamma characteristics of the spatial light modulators.

BRIEF DESCRIPTION OF DRAWINGS

FIG. 3 shows a look-up table indicating a drive sequence for subfields at specific gradation levels;

FIG. 11 shows a look-up table indicating a drive sequence for subfields at specific gradation levels, with subfield-period control;

DETAILED DESCRIPTION OF PREFERRED EMBODIMENTS

Several embodiments according to the present invention will be disclosed with reference to the attached drawings.

First Embodiment

Figure 2:
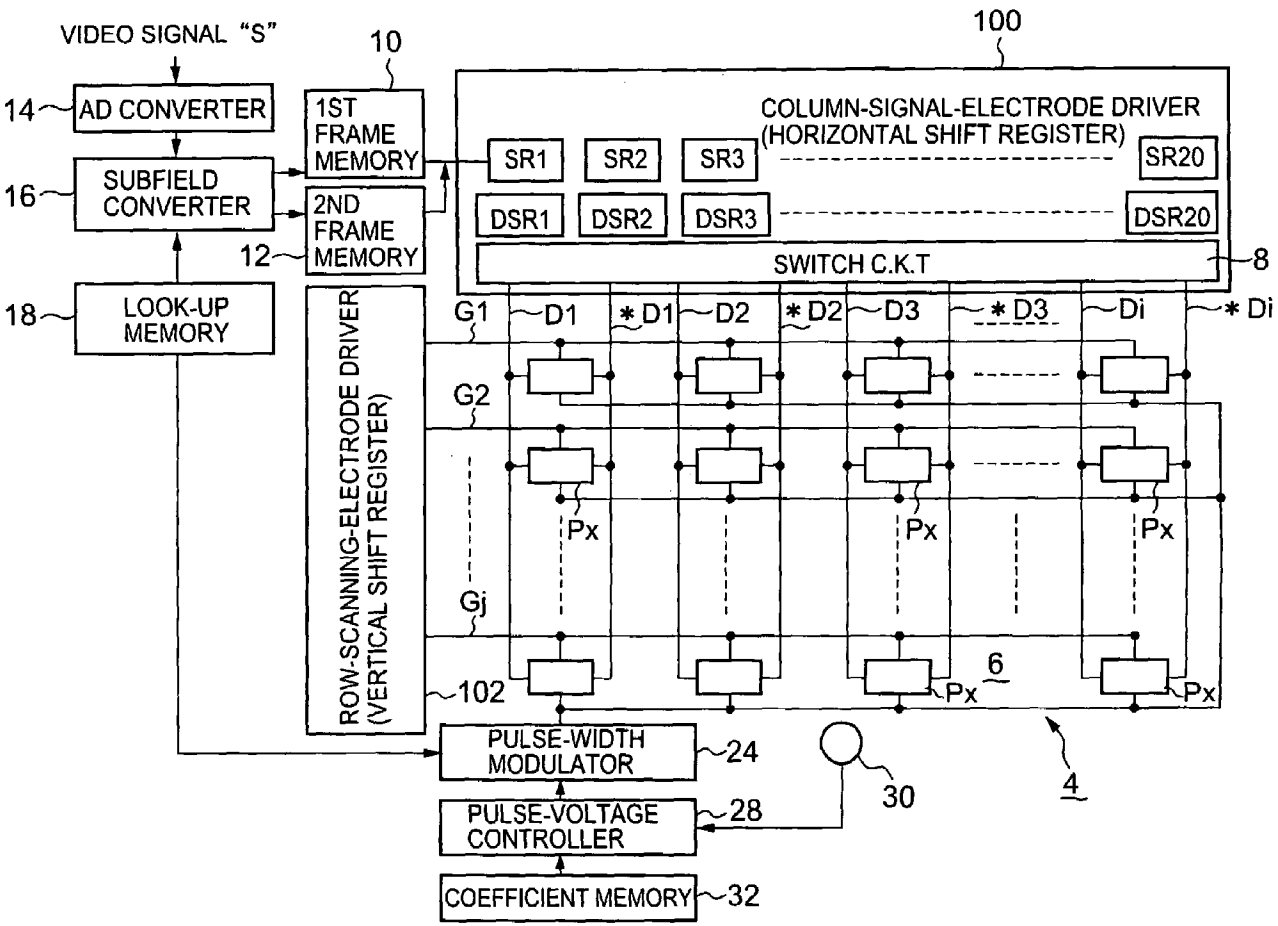
FIG. 2 shows a block diagram of a first embodiment of an active-matrix display according to the present invention.

FIG. 2 shows a block diagram of a first embodiment of an active-matrix display according to the present invention.

In FIG. 2, first column-signal electrodes D1, D2, D3, . . . , and Di are aligned on an active-matrix substrate 6. Also aligned on the substrate 6 are row-scanning electrodes G1, G2, G3, . . . , and Gj, intersecting with the column-signal electrodes. Provided along the first column-signal electrodes are second column-signal electrodes *D1, *D2, *D3, . . . , and *Di for supplying inverted signals of those supplied through the first column-signal electrodes.

A pixel Px is provided at the intersection of each column-signal electrode D (D1, D2, D3, . . . , and Di) and each row-scanning electrode G (G1, G2, G3, . . . , and Gj).

These pixels and column- and row-signal electrodes constitute a liquid-crystal display unit 4.

A column-signal-electrode driver 100 is equipped with horizontal shift registers SR1, SR2, SR3, . . . , and SR20, and DSR1, DSR2, DSR3, . . . , and DSR20, and also a switching circuit 8 for separately switching each first column-signal electrode D and each second column-signal electrodes *D (*D1, *D2, *D3, . . . , and *Di).

Connected to the column-signal-electrode driver 100 are a first frame memory 10 and a second frame memory 12. Connected to these frame memories are a subfield converter 16 and an AD converter 14. An input analog video signal S is converted into a digital signal by the AD converter 14. The digital signal is converted into subfield pulse signals by the subfield converter 16 based on a look-up table (shown in FIG. 3) stored in a look-up memory 18. The subfield pulse signals are then supplied to the first and second frame memories 10 and 12.

The look-up table stored in the look-up memory 18 is explained with reference to FIG. 3.

Listed in the look-up table are 19 subfields SF1, SF2, SF3, . . . , and SF19 into which one field is divided. The subfields last for different periods (each period including a subfield period for driving the liquid crystal LC). In detail, the subfields are aligned such that the subfield period is the shortest for the first subfield SF1 (30 microseconds) and gradually made longer towards the last subfield SF19 having the longest (305 microseconds). The difference in subfield period between successive subfields is equal to one other or becomes shorter as the subfield period becomes longer.

The look-up table shows 256 gradation levels giving "1" for the subfields in which the liquid crystal display is tuned on. The signs "1" are given only at several gradation levels for brevity in FIG. 3.

In the column-signal-electrode driver 100 shown in FIG. 2, multiple switches of the switching circuit 8 are sequentially turned on to allow the video signal S for one horizontal period to be sequentially supplied to the column-signal electrodes D1, D2, D3, . . . , and Di.

A row-scanning-electrode driver 102 shown in FIG. 2 is equipped with a vertical shift register having several register stages corresponding to the number of rows to be displayed.

The vertical shift register sequentially outputs scanning pulses to the row-scanning electrodes G1, G2, G3, . . . , and Gj, per horizontal period (per row). The scanning pulses turn on, sequentially per row, pixel-switching transistors (disposed later) connected to the row-scanning electrodes G1, G2, G3, . . . , and Gj so that pulse voltages sampled at the column-signal electrodes D1, D2, D3, . . . , and Di are applied to the pixels Px per row.

Figure 4:
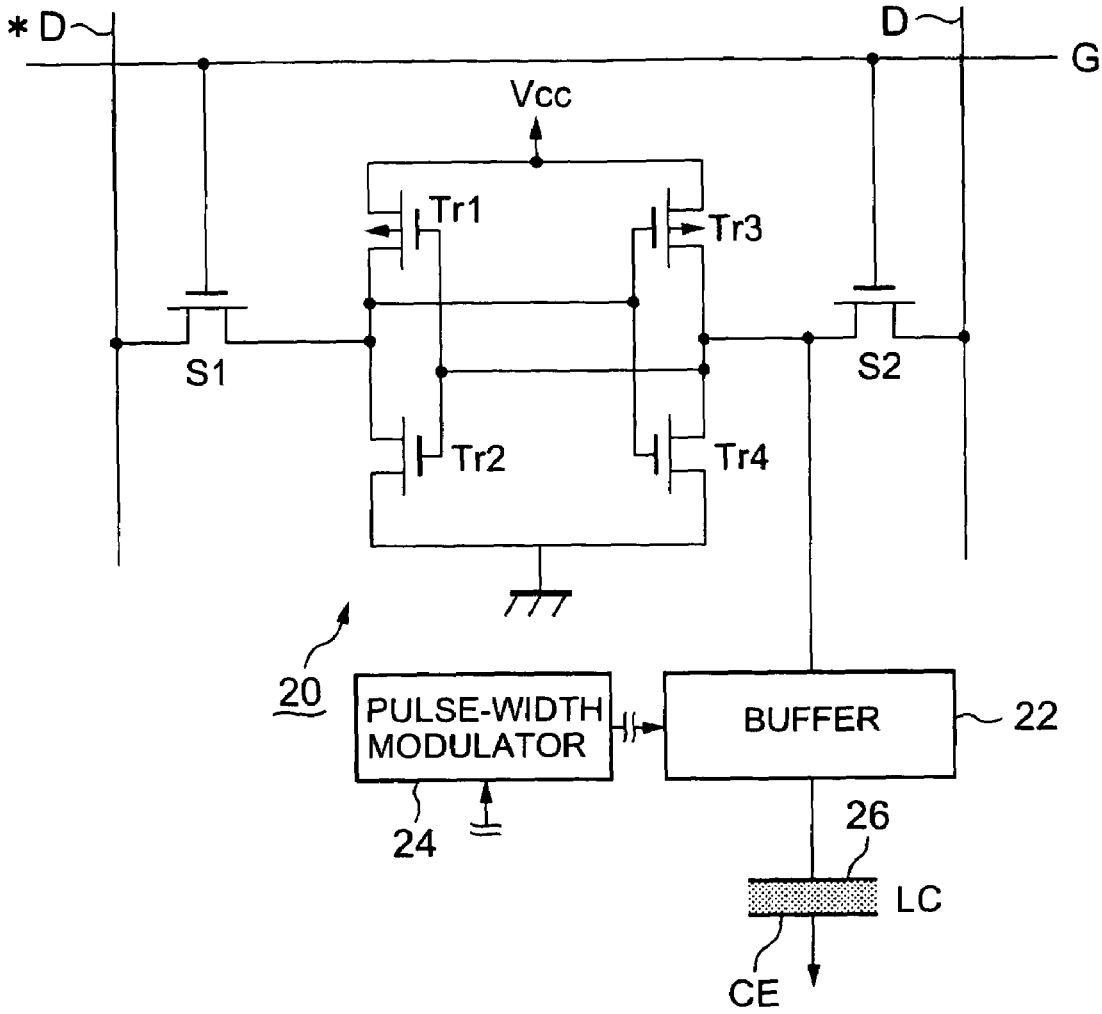
FIG. 4 shows a circuit diagram of a pulse driver for each pixel.

Shown in FIG. 4 is a circuit diagram of a pulse driver for each pixel Px. The digital-based driving of liquid crystals under pulse-width modulation in this embodiment fixes the potential of each electrode, which is hardly affected by stray capacitance between electrodes filled with a liquid crystal, thus causing less problems on images to be displayed than analog-based driving.

The pulse driver shown in FIG. 4 includes an SRAM (Static RAM) 20 for storing input data and a buffer 22 for supplying the data to a pixel electrode 26. The SRAM 20 is a flip-flop circuit having four transistors Tr1 to Tr4 connected to the column-signal electrodes D and *D via switching transistors S2 and S1, respectively.

In synchronism with video-signal data composed of pulse signals supplied to the column-signal electrodes D and *D, pulses are supplied to the row-scanning electrode G connected to the gates of the switching transistors S1 and S2 so that the data is temporarily stored in the SRAM 20.

The buffer 22 has a switch circuit (not shown) which is turned on and off to produce pulses by a switching signal supplied from an external pulse-width modulator 24 (FIG. 2) so that the data stored in the SRAM 20 is supplied to a liquid crystal LC filled between the pixel electrode 26 and a common electrode CE, via the pixel electrode 26, while the switch circuit is on, to drive liquid crystal molecules. The pulse-width modulator 24 is connected to the buffer 22 of the pulse driver for every pixel Px.

Connected to the pulse-width modulator 24 is a pulse-voltage controller 28, as shown in FIG. 2, to control the voltage level of the pulses produced by the buffer 22 so as to compensate for change in the gamma characteristics of the liquid-crystal display unit 4, due to change in temperature.

Connected to the pulse-voltage controller 28 is a temperature sensor 30, such as a thermocouple, for monitoring the temperature of the liquid crystal LC (FIG. 4), the monitored temperature being sent to the controller 28. The thermocouple may be embedded in the active-matrix substrate 6.

The pulse-voltage controller 28 is equipped with a coefficient memory 32 storing data of temperatures and the corresponding compensation coefficients, for controlling the voltage level of the pulses produced by the buffer 22 (FIG. 4) based on the stored data. The table is made based on several characteristic curves shown in FIG. 5, each curve exhibiting the reverse characteristics of the output characteristics shown in FIG. 1, for compensating for the latter characteristics.

Disclosed below is the operation of the liquid crystal display (FIG. 2) as the first embodiment according to present invention.

The feature of the operation of the first embodiment of the liquid crystal display lies in adjustments to pulse voltages applied to the pixels based on the temperature of the liquid crystals monitored by the temperature sensor 30, to give the liquid crystals the constant gamma characteristics.

In FIG. 2, an analog input video signal S is converted into a digital signal by the AD converter 14 and supplied to the subfield converter 16. If the video signal S is a digital signal, it is directly supplied to the subfield converter 16.

A pixel signal corresponding to each pixel Px carried by the video signal S is divided into, for example, 19-bit subfields having the corresponding subfield periods predetermined as shown in FIG. 3. In detail, the video signal S is divided into a specific number of subfields, for example 19 subfields, based on the data of the look-up table of the look-up memory 18. The data stored in the look-up memory 18 are to be converted in accordance with gradation levels of the input video signal S. The number of the subfields may be larger or smaller than 19.

Physical addresses are appointed when an external write-control address signal is supplied to the subfield converter 16. Data of the look-up table of the look-up memory 18 are then written in the first and second frame memories 10 and 12 at the appointed physical addresses. The first and second frame memories 10 and 12 consist of 19 subfield memories (not shown), corresponding to the 19 subfields, to store subfield data for 640×480 pixels Px, for example.

The data stored in the subfield memories are read, for example per 32 bits, and stored in the shift registers SR1 to SR20 of the column-signal-electrode driver 100.

Data of 640 bits correspond to one column of pixels Px. After stored in the shift registers SR1 to SR20, the data are transferred to the memories (FIG. 4) of the first column of pixels Px. Data transfer is continued for the second, the third, . . . , and the 480th column of pixels Px for one subfield. On completion of data transfer for the first subfield and data storage in the memories of all the columns of pixels Px, liquid-crystal driving voltages are simultaneously applied to all the pixels Px via the pulse-width modulator 24 and the buffer 22 in accordance with the data stored in the memories of all the columns of pixels Px., to simultaneously drive the liquid crystals of all the pixels Px.

The same operation is continued for the second, the third, . . . , and the 19th subfield to complete displaying for one field.

While data are read out from the first frame memory 10, other data are written in the second frame memory 12 from the subfield converter 16. On completion of data read from the first frame memory 10 for one field, other one-field data are read from the second frame memory 12. Thereafter, write and read operations in and from the first and second frame memories 10 and 12 are alternately performed per field.

The number of the horizontal shift registers SR (SR1, SR2, . . . ) and DSR (DSR1, DSR2, . . . ) shown in FIG. 2 depends on how many pixels Px are aligned in the horizontal direction. The number of pixels Px aligned in the horizontal direction is 640 in this embodiment. Each data transfer at, for example, 32 bits (32 pixels) requires 20 shift registers SR and also 20 shift registers DSR, given by 640/32 =20.

The number of the subfields "19" in this embodiment means there are 19 subfield images for one field period (1/60 seconds) when one subfield image is composed of 640 pixels in the horizontal direction and 480 pixels in the vertical direction.

As disclosed with reference to FIG. 4, the memory for each pixel Px consists of the SRAM 20 for storing input data and the buffer 22 for supplying the data to the pixel electrode 26. The SRAM 20 stores the input data in the flip-flop circuit having the transistors Tr1 to Tr4 connected to the column-signal electrodes D and *D via the switching transistors S2 and S1, respectively.

In synchronism with the operational timing of the SRAM 20, pulses are supplied to the row-scanning electrode G (G1, G2, G3, . . . , and Gj) connected to the gates of the switching transistors S1 and S2 so that the data is temporarily stored in the SRAM 20.

The switch circuit (not shown) installed in the buffer 22 is turned on and off to produce pulses by a switching signal supplied from the pulse-width modulator 24 (FIG. 2). The modulator 24 reads subfield period data stored in the look-up memory 18 to apply the data stored in the SRAM 20 to the pixel electrode 26 as pulse signals for the subfield period read from the memory 18 via the buffer 22 to drive the liquid crystal LC.

In application of data stored in the SRAM 20 as pulse signals, not only the subfield period but also the voltage levels of the pulse signals are controlled in this embodiment.

In detail, the temperature sensor 30 (FIG. 2) always monitors the temperature of the liquid crystals LC. In response to the monitored temperature, the pulse-voltage controller 28 controls the voltage levels of the pulse signals via the pulse-width modulator 24, while accessing the compensation coefficient data stored in the coefficient memory 32, to compensate for the temperature-dependent change in the gamma characteristics of the liquid crystals LC.

Figure 1:
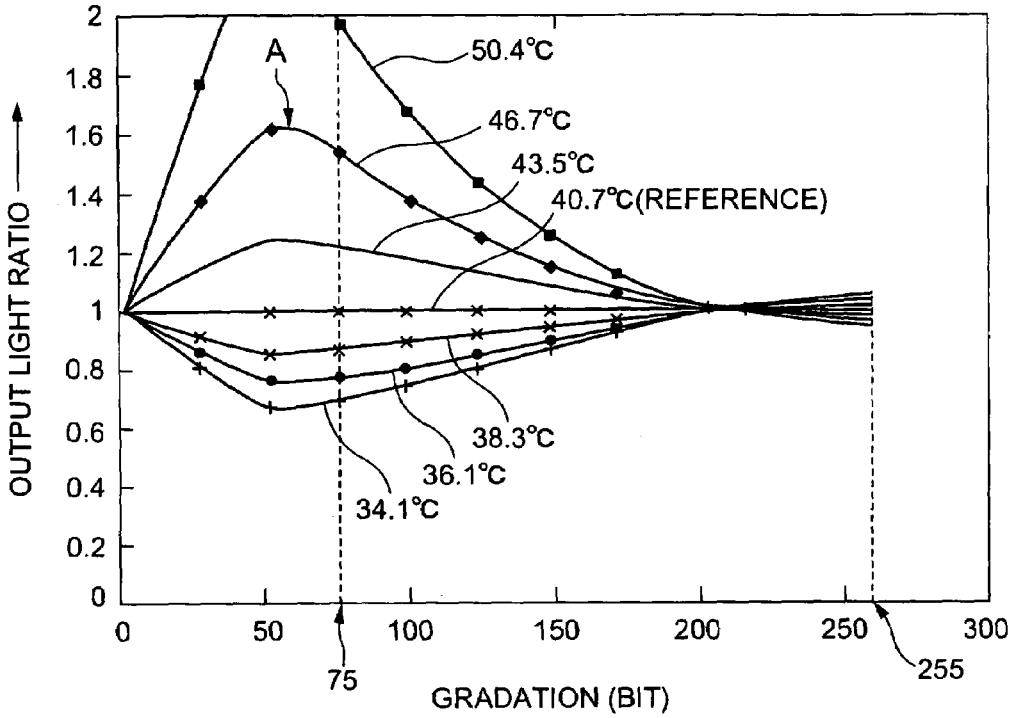
FIG. 1 shows the dependency of gamma characteristics on temperature.

For example, when the temperature of the liquid crystals LC monitored by the temperature sensor 30 is 46.7° C., as shown in FIG. 1, the gamma characteristics (output light ratio) increases up to about 1.6 (the peak) at the intermediate gradation of about 50 bits (a characteristic curve A).

Figure 5:
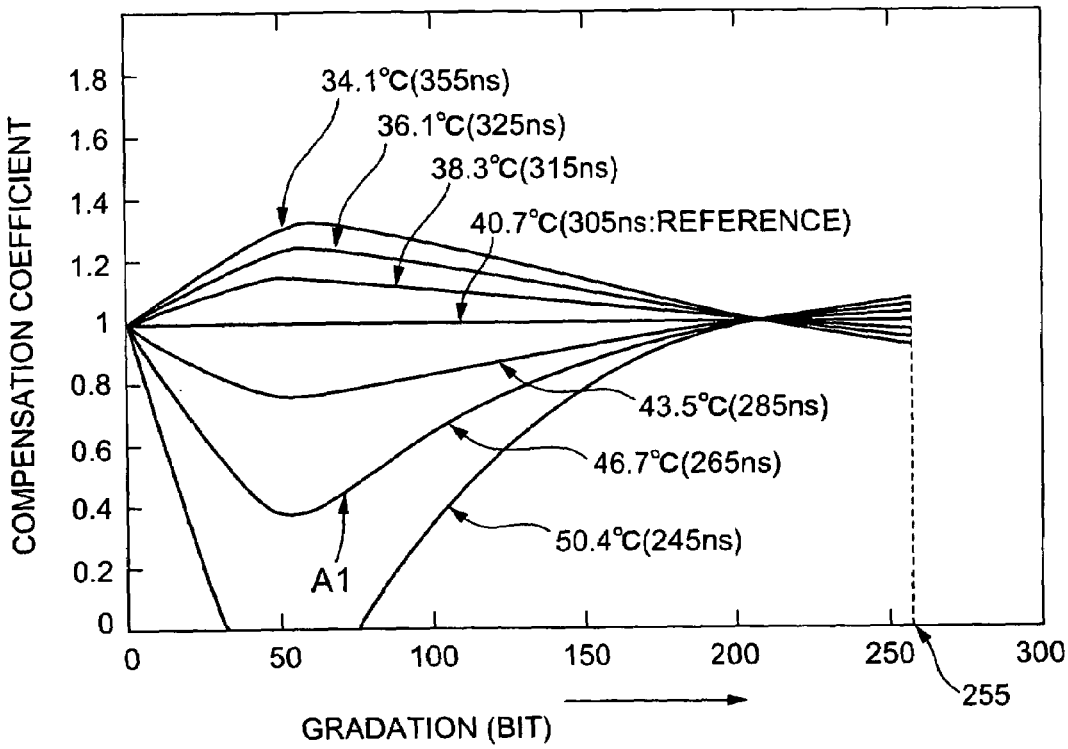
FIG. 5 shows the characteristics curves of compensation coefficients against gradation levels with temperature as a parameter.

In order to compensate for this change in the gamma characteristics, the pulse-voltage controller 28 accesses the coefficient memory 32 to read compensation coefficients on a coefficient curve A1 at 46.7° C. shown in FIG. 5. The coefficient curve A1 having the minimum level at about 50 bits, which is almost the reverse curve of the characteristic curve A shown in FIG. 1.

The pulse-voltage controller 28 applies weighting to the pulse signals by the compensation coefficients on the coefficient curve A1 based on the pulse voltage level at 40.7° C., to increase or decrease the voltage levels of the pulse signals thus offering constant gradation without respect to temperature change.

Shown in FIG. 5 is an example of compensation coefficients at several temperatures. Compensation coefficients at all temperatures to be predicted can be given by proportional division or stored in memory.

Figure 6:
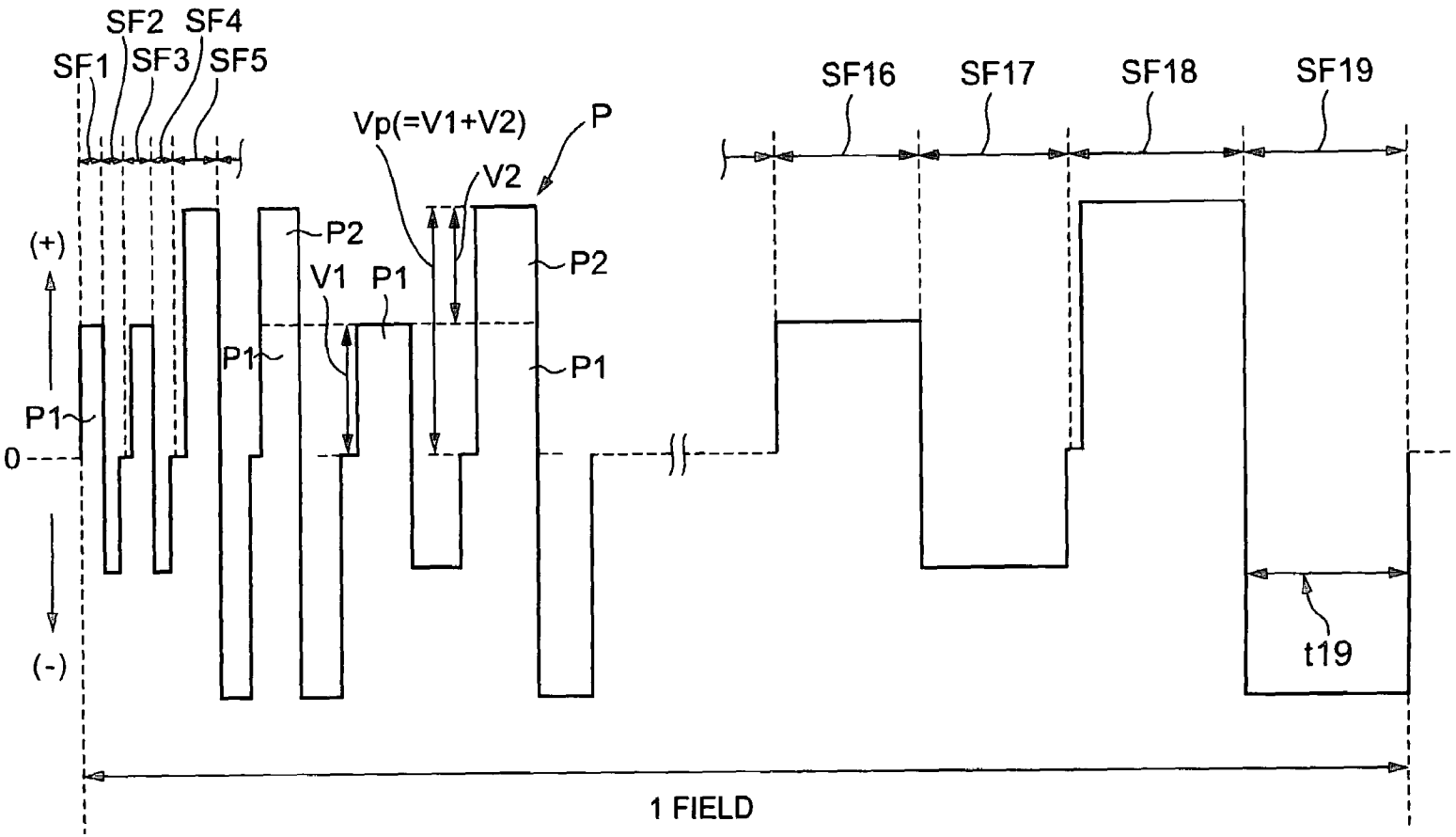
FIG. 6 shows an exemplary waveform of pulse signals to be applied to each pixel.

Illustrated in FIG. 6 is an exemplary waveform of pulse signals to be applied to each pixel Px.

One field is divided into 19 subfields SF1 to SF19 having the subfield periods, the closer to the subfield SF19, the longer the subfield period, as shown in FIG. 3. The pulse signals have alternate waveforms between positive and negative for consecutive pulses so that D. C. components cannot be applied to the pixel Px. The voltage level of the pulse signals is zero between two consecutive subfields for switching the pulse signals per subfield.

Each pulse signal P consists of a first pulse P1 that exists for every subfield and a second pulse P2 that is superimposed on the first pulse P1 when each bit is "1", or "on" in accordance with the digital video signal. In other words, each pulse signal P consists of the first pulse P1 that is produced in accordance with the subfield period of the corresponding subfield divided from one field and the second pulse P2 that is produced in accordance with the digital video signal.

In detail, the first pulse P1 always exists at bit data "1" and also "0". A voltage level V1 of the pulse P1 is adjusted at a level little bit lower than a threshold level at which the liquid crystal LC is driven. A voltage level V2 of the second pulse P2 is adjusted to give a total voltage level Vp (=V1+V2) when the pulse P2 is superimposed on the pulse P1, which is enough for driving the liquid crystal LC. The pulse widths are adjusted so that a pulse width of the pulse P1 is equal to or wider than that of the pulse P2.

The following are three modes of controlling the voltage level of each pulse signal P:

(1) Adjust the voltage levels V1 and V2 to give a certain constant total voltage level Vp;

(2) Adjust the voltage level V2 only (the voltage level V1 being constant, the total voltage level Vp depending on the adjusted voltage level V2); and (3) Adjust the voltage level V1 only (the voltage level V2 being constant, the total voltage level Vp depending on the adjusted voltage level V1).

Figure 7A:
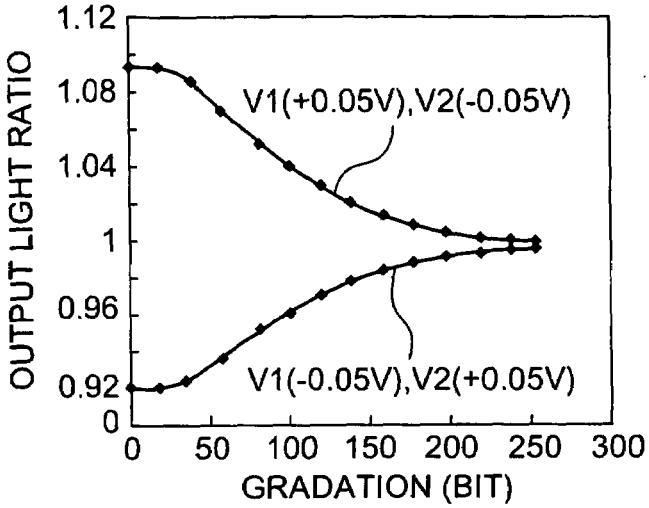
FIGS. 7A, 7B and 7C show the characteristic curves of output light ratio against gradation levels with pulse voltage as a parameter.
Figure 7B:
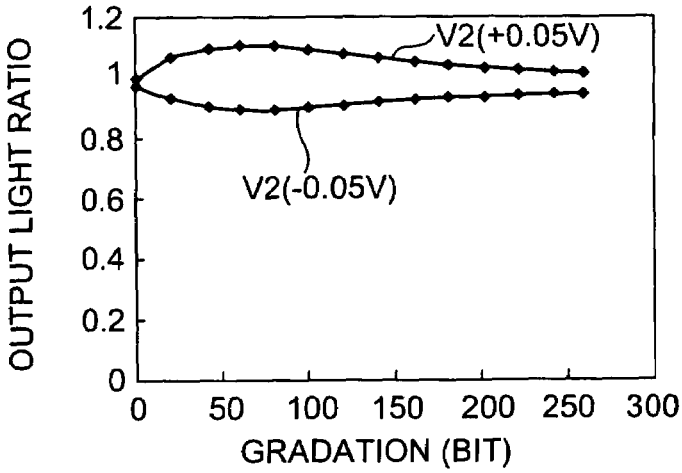
Figure 7C:
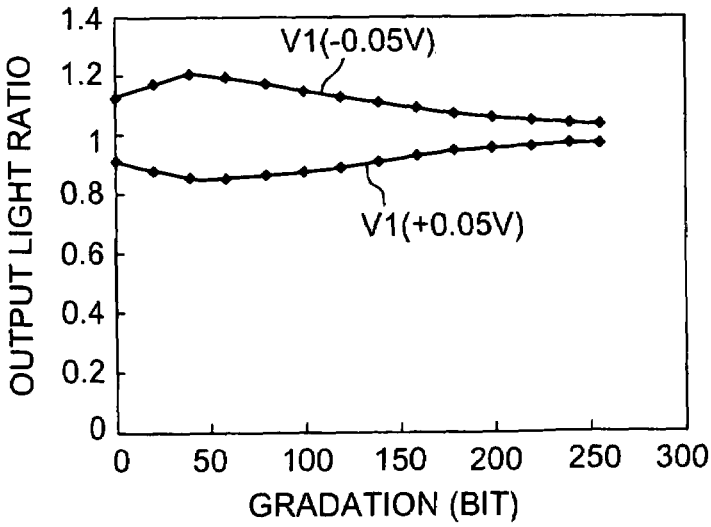

Discussed below with reference to FIGS. 7A, 7B and 7C is the evaluation of brightness (output light ratio) of the liquid crystal LC in the three voltage-control modes (1), (2) and (3).

FIGS. 7A, 7B and 7C show characteristic curves in the three voltage-control modes (1), (2) and (3), respectively, based on the brightness at 40. 7° C. in temperature of the liquid crystal LC, like shown in FIG. 1.

One of the characteristic curves shown in FIG. 7A was given at the voltage level V1 adjusted as higher than a reference level by 0.05 volts and the voltage level V2 lower than the reference level by 0.05 volts. The other characteristic curve shown in FIG. 7A was given at the voltage level V1 adjusted as lower than a reference level by 0.05 volts and the voltage level V2 higher than the reference level by 0.05 volts. The characteristic curves given under the voltage-control mode (1) exhibit the output light ratio higher or lower than the reference level "1" at almost bit "0" (lower gradation range), which becomes closer to "1" as the bit increases (higher gradation range). These characteristic curves are very different from those shown in FIG. 1 so that the former curves cannot compensate for the latter curves. Thus, the mode (1) for giving the characteristic curves shown in FIG. 7A is not a feasible way of voltage control.

One of the characteristic curves shown in FIG. 7B was given at the voltage level V2 adjusted as higher than the reference level by 0.05 volts (the voltage level V1 being constant). The other characteristic curve shown in FIG. 7B was given at the voltage level V2 adjusted as lower than the reference level by 0.05 volts (the voltage level V1 being constant). The characteristic curves given under the voltage-control mode (2) exhibit the output light ratio higher or lower than the reference level "1" at bit in the range from "50" to "70" (intermediate gradation range), which becomes closer to "1" as the bit increases (higher gradation range) or decreases (lower gradation range). These characteristic curves are very similar to those shown in FIG. 1 so that the former curves can compensate for the latter curves. Thus, the mode (2) for giving the characteristic curves shown in FIG. 7B is a feasible way of voltage control.

One of the characteristic curves shown in FIG. 7C was given at the voltage level V1 adjusted as higher than the reference level by 0.05 volts (the voltage level V2 being constant). The other characteristic curve shown in FIG. 7C was given at the voltage level V1 lower than the reference level by 0.05 volts (the voltage level V2 being constant). The characteristic curves given under the voltage-control mode (3) exhibit the output light ratio higher or lower than the reference level "1" at bit in the range from "40" to "60" (intermediate gradation range), which becomes closer to "1.1" or "0.9" as the bit decreases (lower gradation range) whereas closer to "1" as the bit increases (higher gradation range). These characteristic curves are similar to those shown in FIG. 1, although not so similar compared to those shown in FIG. 7B. The characteristic curves shown in FIG. 7C can also compensate for those shown in FIG. 1. Therefore, the mode (3) for giving the characteristic curves shown in FIG. 7C is another feasible way of voltage control.

As discussed above, in this embodiment, the characteristic curves, such as shown in FIGS. 7B and 7C, that are almost reverse curves of those shown in FIG. 1, are given by adjusting the voltage level V1 of the first pulse P1 only or the voltage level V2 of the second pulse P2 only for each pulse signal P shown in FIG. 6, for example, by ±0.01 volts, ±0.02volts, ±0.03 volts, . . . , or ±0.1 volts, based on the brightness at 40.7° C. in temperature of the liquid crystal LC. The characteristic curves are prestored in the coefficient memory 32 with the temperature of the liquid crystal LC as a parameter.

The compensation coefficient data stored in the coefficient memory 32 are looked up based on the temperature of the liquid crystal LC monitored by the temperature sensor 30. The voltage level V1 of the pulse P1 only or the voltage level V2 of the pulse P2 only is then adjusted based on the compensation coefficient data for each pulse signal P shown in FIG. 6 to compensate for change in the gamma characteristics of the liquid crystal LC due to change in temperature of the liquid crystal LC, thus achieving optimal gradation display.

The look-up table shown in FIG. 3 is explained further in detail. Indicated in this table is that one field (TV field) of a digital video signal is divided into the 19 subfields SF1 to SF19 having different subfield periods. The subfields are aligned such that the subfield period is the shortest for the first subfield SF1 (30 microseconds) and gradually made longer towards the last subfield SF19 having the longest (305 microseconds).

In a gradation range, such as, from the gradation levels 21 to 36, as the level becomes higher, the subfields which are turned on ("1"), or for which the liquid crystal display is turned on, are shifted from the subfield having the shortest subfield period by one subfield towards the subfield having the longest subfield period. And, also, in the range from gradation level 21 to 36, when the subfield having the longest subfield period is turned on at a certain gradation level among those which have been turned off, the subfield having the longest subfield period is continuously turned on at gradation levels higher than the certain gradation level. Although not shown, the arrangements are made repeatedly at the gradation levels higher than the level 37. For example, the sub-field SF17 is on ("1") at the gradation level 20 and higher, and the sub-field SF16 is on ("1") at the gradation level 36 and higher.

Furthermore, in FIG. 3, as shown in the range from gradation level 1 to 10, the subfield which is turned on ("1") at a lower gradation level is shifted by two subfields or more from the subfield having the shortest subfield period towards that having the longest subfield period, and the subfield having the longest subfield period which is on ("1") at a certain gradation level is continuously turned on at gradation levels higher than the certain gradation level. For example, the sub-field SF19 is on ("1") at the gradation level 2 and higher, and the sub-field SF18 is on ("1") at the gradation level 6 and higher (the sign "1" being omitted at levels 7 to 9 and levels 11 to 19 for brevity).

This driving sequence reduces pseudo-edge noises (false edge effects) which may otherwise be generated when a picture moves.

The alignment of subfields shown in FIG. 3 is just an example in this embodiment. The gradation levels may be more than or less than 256 levels. The number of subfields may be larger or smaller than 19. All the subfield periods may be equal to one another.

Moreover, the first and second pulses P1 and P2 have the same width for each pulse signal P in FIG. 6 in the embodiment. Nonetheless, the width of the second pulse P2 may be narrower than that of the first pulse P1 at a given constant ratio. The first pulse P1 always exists at bit data "1" and also "0" in FIG. 6, which may, however, be cancelled at "0".

The pulse driver for each pixel Px is not limited to that shown in FIG. 4. The gamma-characteristic compensation disclosed above in this embodiment is applied to each color of R, G and B for full-color liquid crystal display.

Second Embodiment

Figure 8:
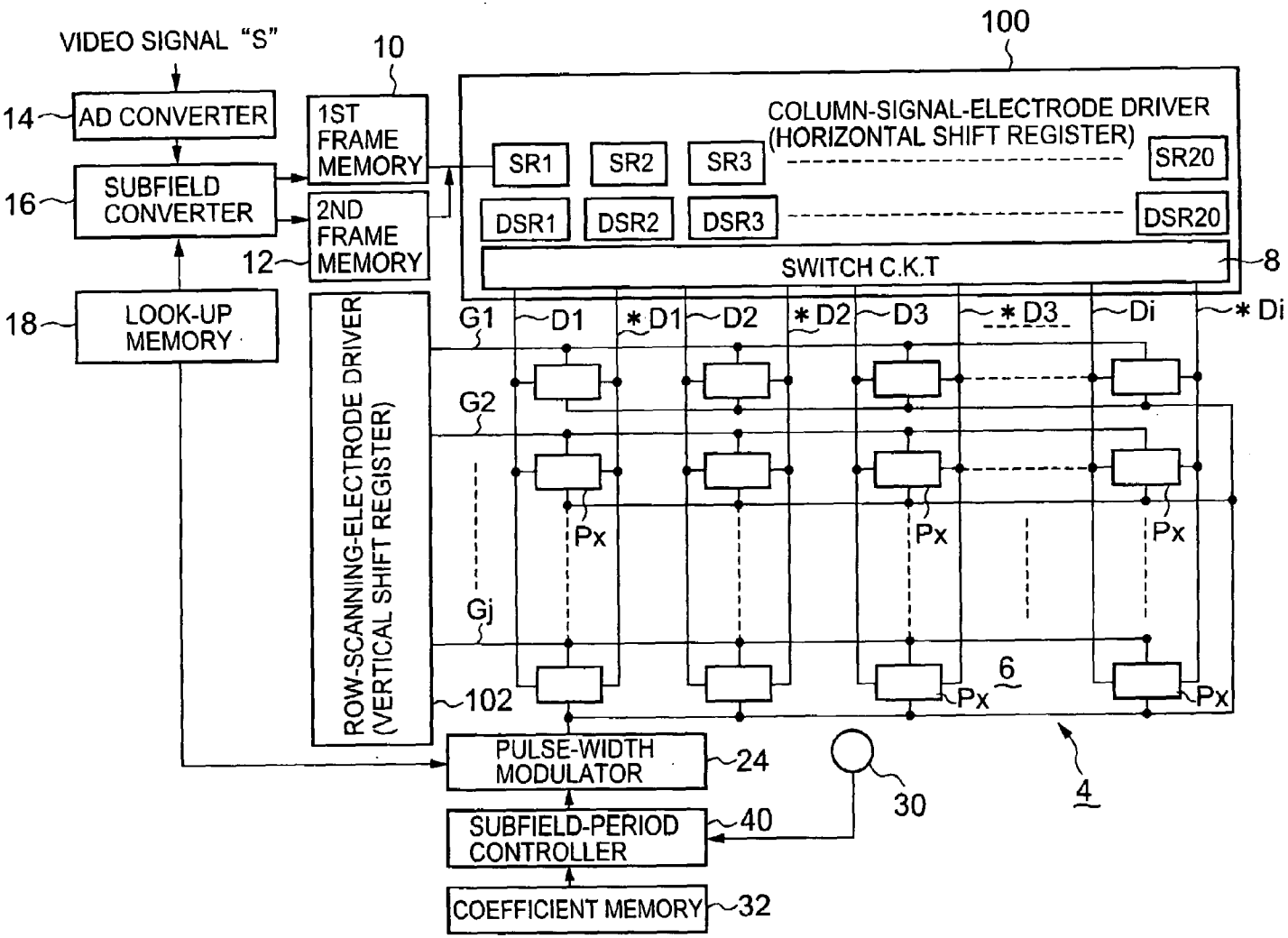
FIG. 8 shows a block diagram of a second embodiment of an active-matrix display according to the present invention.

FIG. 8 shows a block diagram of a second embodiment of an active-matrix display according to the present invention. The elements shown in FIG. 8 the same as or analogous to those shown in FIG. 2 are given the same reference numerals and not explained.

The second embodiment of the active-matrix display shown in FIG. 8 is equipped with a subfield-period controller 40 connected to the pulse-width modulator 24, for varying the subfield period of one or more of the subfields discussed above, such as shown in FIG. 3, so as to compensate for change in the gamma characteristics of the liquid-crystal display unit 4, due to change in temperature.

Connected to the subfield-period controller 40 is the temperature sensor 30, such as a thermocouple, for monitoring the temperature of the liquid-crystal display unit 4, the monitored temperature being sent to the controller 40. The thermocouple may be embedded in the active-matrix substrate 6.

The subfield period controller 40 is equipped with the coefficient memory 32 storing data of temperatures and the corresponding compensation coefficients, for varying the subfield period of one or more of the subfields based on the data.

The subfield to be subjected to period-length control in the second embodiment is the subfield SF19 shown in FIG. 3, having 305 microseconds, the longest subfield period, and for which the liquid crystal display is turned on ("1") in the wide range of gradation from low to high levels. The longer the better for the subfield period for period-length control. Not only the subfield SF19, but also several subfields may be subjected to period-length control.

The look-up table stored in the coefficient memory 32 in the second embodiment is made up of characteristic curves, such as shown in FIG. 5, for compensating for change in the gamma characteristics of the liquid crystal display, like the first embodiment.

Disclosed below is the operation of the liquid crystal display (FIG. 8) of the second embodiment according to present invention.

Like the first embodiment, the pulse-width modulator 24 accesses subfield-period data stored in the look-up memory 18 and applys the data stored in the SRAM 20 to the pixel electrode 26 as pulse signals for the subfield period read from the memory 18 via the buffer 22 to drive the liquid crystal LC, such as shown in FIG.4.

In the second embodiment, the feature of the operation of the liquid crystal display lies in adjustments to at least one subfield, for example, the longest subfield, based on the temperature of the liquid crystals monitored by the temperature sensor 30, to give the liquid crystals the constant gamma characteristics.

In detail, for example, when the temperature of the liquid crystals LC monitored by the temperature sensor 30 is 46.7° C., as shown in FIG. 1, the gamma characteristics (output light ratio) increases up to about 1.6 (the peak) at the intermediate gradation of about 50 bits (the characteristic curve A).

In order to compensate for this change in the gamma characteristics, the subfield-period controller 40 accesses the coefficient memory 32 to read compensation coefficients on the coefficient curve A1 shown in FIG. 5. The coefficient curve A1 having the minimum level at about 50 bits, which is almost the reverse curve of the characteristic curve A shown in FIG. 1.

The subfield period controller 40 applies weighting to the pulse signals by the compensation coefficients on the coefficient curve A1 based on the pulse voltage level at 40.7° C., to widen or narrow the subfield of the pulse signals, thus offering constant gradation without respect to temperature change.

In order to select the best coefficient curve from FIG. 5, a subfield period t19 (longest period) of the subfield SF19 is adjusted in this embodiment in accordance with the temperature monitored by the temperature sensor 30.

As shown in FIG. 3, the subfield period t19 of the subfield SF19 is 305 microseconds at 4.07° C. (reference temperature). When the temperature of the liquid crystal LC monitored by the temperature sensor 30 is varying below 40.7° C., the subfield period t19 is adjusted so that it gradually becomes longer than 305 microseconds, as shown in FIG. 5, whereas when it is varying over 47.7° C., the period t19 is adjusted so that it gradually becomes shorter than 305 microseconds.

Shown in FIG. 5 are the compensation coefficients versus gradation (bits) given when the subfield period t19 of the subfield SF19 is varying in the range from 245 to 335 microseconds, from 305 microseconds (reference) and the temperature is varying in the range from 50.4 to 34.1° C., from 4.07° C. (reference). The ranges of temperature and subfield period shown in FIG. 5 are just examples and not limited to these in the present invention.

Figure 9:
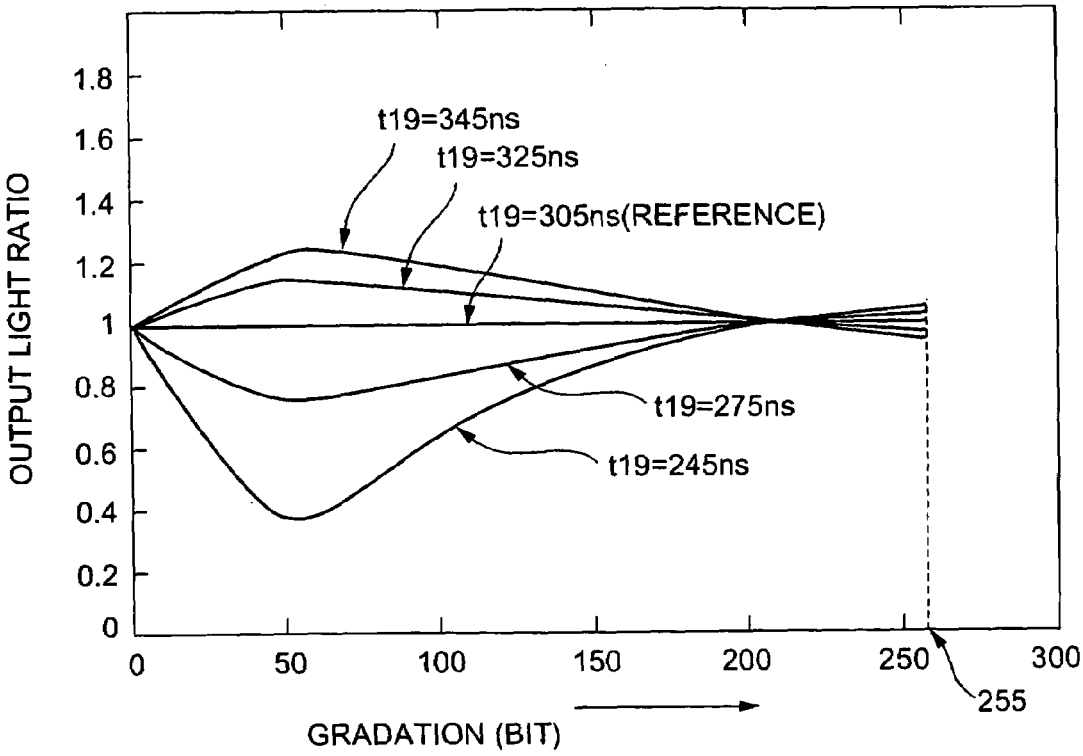
FIG. 9 shows the characteristic curves of output light ratio against gradation levels with subfield period as a parameter.

The subfield-period control in the second embodiment is evaluated with reference to FIG. 9.

Shown in FIG. 9 are several gamma characteristic curves (output light ratio) against gradation (bits) with the subfield period t19 (longest period) of the subfield SF19 as a parameter, based on the brightness at 4.07° C. in temperature of the liquid crystal LC, like shown in FIG. 1.

The characteristic curves (output light ratio) shown in FIG. 9 were given by varying the subfield period t19 of the subfield SF19 in the range from 245 to 345 microseconds, from 305 microseconds (reference).

FIG. 9 shows that the characteristic curves exhibit the output light ratio higher or lower than the reference level "1" at bit in the range from 50 to 70 (intermediate gradation range), which becomes closer to "1" as the bit decreases (lower gradation range) or increases (higher gradation range).

These characteristic curves are very similar to those shown in FIG. 1 so that the former curves can compensate for the latter curves. Thus, the subfield-period control in the second embodiment is a feasible way of compensating for change in the gamma characteristic curves.

As discussed above, in this embodiment, the characteristic curves, such as shown in FIG. 9, that are almost reverse curves of those shown in FIG. 1 are given by adjusting the subfield period t19 of the subfield SF19, for example, by ±10 microseconds, ±20 microseconds, ±30 microseconds, . . . , and ±60 microseconds from 305 microseconds, based on the brightness at 4.07° C. in temperature of the liquid crystal LC. The characteristic curves are prestored in the coefficient memory 32 with the temperature of the liquid crystal LC as a parameter.

The compensation coefficient data stored in the coefficient memory 32 are looked up based on the temperature of the liquid crystal LC monitored by the temperature sensor 30. The subfield period t19 of the subfield SF19 of the pulse signals is then adjusted based on the compensation coefficient data to compensate for change in the gamma characteristics of the liquid crystal LC due to change in temperature of the liquid crystal LC, thus achieving optimal gradation display.

The alignment of subfields shown in FIG. 3 is just an example in this embodiment. The gradation levels may be more than or less than 256 levels. The number of subfields may be larger or smaller than 19.

In the second embodiment, the subfield period t19 (longest period) of the subfield SF19 shown in FIG. 3 is subjected to subfield-period control. The present invention is, however, not limited to that. For example, next to the subfield SF19, a subfield SF20 (the 20th subfield) may be provided for subfield-period control. A subfield period, for example, 200 microseconds, is given to the subfield SF20. Also given to the subfield SF20 is "1" at gradation levels, for example, ranging from 1 to 255 (except level 0) at which the liquid crystal display is turned on. Then, the subfield period of the subfield SF20 can be adjusted, for example, in the range from 140 to 220 microseconds, for compensating for change in the gamma characteristics, like disclosed above.

Moreover, the subfield to be subjected to subfield-period control is not only the subfield SF19 having the bit "1" from the gradation level 2, but also a subfield SF8 having the bit "1" from the gradation level 10 or a subfield SF17 having the bit "1" from the gradation level 20, for example.

One requirement for subfield-period control is that, for example, once the subfield SF8 having the bit "1" (display being on) from the gradation level 10 is used for subfield-period control, the bit "1" has to be given to the subfield SF8 at all gradation levels from 10 to 255. Likewise, when the subfield SF17 having the bit "1" from the gradation level 20 is used for subfield-period control, the bit "1" has to be given to the subfield SF17 at all gradation levels from 20 to 255. The bit "0", if given in these gradation ranges, causes nonlinear gradation.

The pulse widths are adjusted so that a pulse width of the first pulse P1 is equal to that of the second pulse P2 in FIG. 6. Not only that, the pulse width of the second pulse P2 may be narrower than that of the first pulse P1 at a certain constant ratio for each pulse signal P. In addition, the first pulse P1 always exists at bit data "1" and also "0" in FIG. 6, which may, however, be cancelled at "0".

Furthermore, FIG. 3 shows a driving sequence having a pattern in which the liquid crystal display is tuned into bright once in one field. Another feasible driving sequence has a pattern in which the liquid crystal display is turned into bright twice or more in one field, which generates little flickers.

The pulse driver for each pixel Px is not limited to that shown in FIG. 4. The gamma-characteristic compensation disclosed above in this embodiment is applied to each color of R, G and B for full-color liquid crystal display.

The first and the second embodiment employ automatic pulse-voltage and subfield-period control, respectively, based on the monitored temperature. In addition to the automatic pulse-voltage or subfield-period control or instead of this, the pulse voltage or the subfield period can be adjusted manually, for instance, when shipped from a factory or by an end user at home while viewing images on screen.

In other words, the present invention offers three ways of adjustments to the pulse voltage or the subfield period: automatic adjustments based on the monitored temperature; the automatic adjustments and manual adjustments based on the quality of images on screen; and the manual adjustments.

Particularly, the manual adjustments to the pulse voltage or the subfield period after the automatic adjustments enables sensitive control on the gamma characteristics such as brightness control in the middle of gray levels.

Furthermore, the adjustments to the pulse voltage or the subfield period independently on each color of, for example, R, G and B, allow adjustments to color temperature in the middle of gray levels or dark gray levels.

In fact, the maximum output light of each color channel has to be controlled in order to control the color temperature, the impression of images being greatly changed by varying the middle of gray levels.

Third Embodiment

Figure 10:
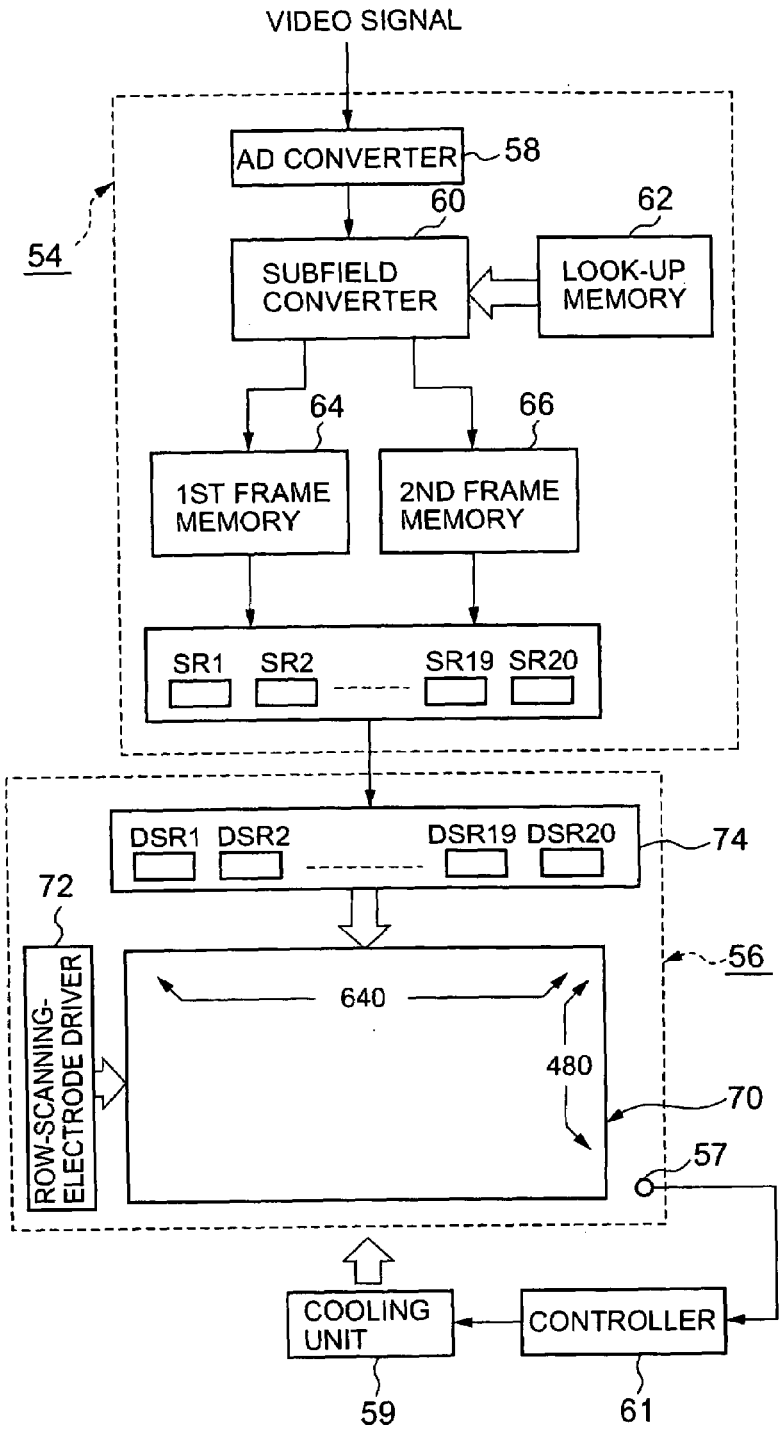
FIG. 10 shows a block diagram of a third embodiment of an active-matrix display according to the present invention.

FIG. 10 shows a block diagram of a third embodiment of an active-matrix display according to the present invention.

The third embodiment of the active-matrix display shown in FIG. 10 is mainly equipped with a subfield controller 54 for converting an input video signal into a digital signal and diving one field of the digital signal into a plurality of subfields; a liquid-crystal display unit 56 having multiple pixels arranged in a matrix to display images when the digital signal is supplied; a temperature sensor 57 for monitoring the temperature of the display unit 56; a cooling unit 59 for cooling the display unit 56; and a controller 61 for controlling the cooling unit 59 in accordance with the monitored temperature.

The subfield controller 54 is equipped with an A/D converter 58 for converting an input video signal into a digital signal; a subfield converter 60 for dividing one field of the digital video signal into 19 subfields; a look-up memory 62 for storing a look-up table, such as shown in FIG. 11, to be used for field division; a first frame memory 64 and a second frame memory 66 for storing the output signals of the subfield converter 60; and twenty shift registers SR1 to SR20. The number of the divided subfields may be more or less than 19.

The display unit 56 is equipped with a display panel 70 having 640×480 pixels arranged in a matrix, a row-scanning-electrode driver 72 and a column-signal-electrode driver 74, both drivers being connected to the display panel 70. The column-signal-electrode driver 74 includes shift registers DSR1 to DSR20 for storing data sent from the shift registers SR1 to SR20.

The number of the horizontal shift registers SR (SR1, SR2, . . . ) and DSR (DSR1, DSR2, . . . ) shown in FIG. 10 depends on how many pixels are aligned in the horizontal direction. The number of pixels aligned in the horizontal direction is 640 in this embodiment. Each data transfer at, for example, 32 bits (32 pixels) requires 20 shift registers SR and also 20 shift registers DSR, given by 640/32=20.

The number of the subfields "19" in this embodiment means there are 19 subfield images for one field period (1/60 seconds) when one subfield image is composed of 640 pixels in the horizontal direction and 480 pixels in the vertical direction.

Figure 12:
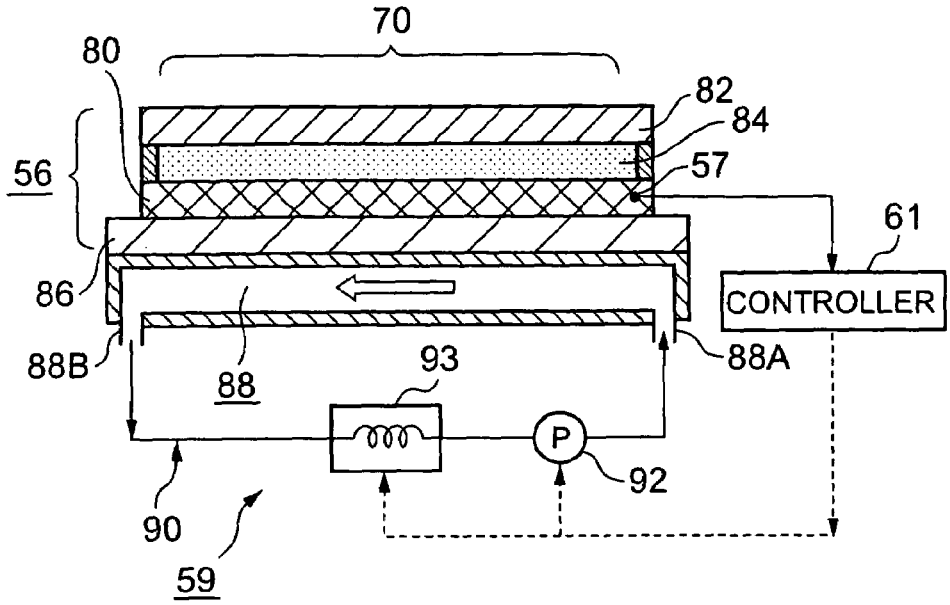
FIG. 12 shows the structure of a liquid-crystal display unit with a cooling mechanism in the third embodiment of the active-matrix display according to the present invention.

The structure of the display panel 70 installed in the liquid-crystal display unit 56 is disclosed with reference to FIG. 12.

Although not shown in FIG. 12, transistors, several types of elements, matrix pixel electrodes, the row-scanning-electrode driver 72, the shift registers DSR1 to DSR20 of the column-signal-electrode driver 74, the shift registers SR1 to SR20, etc., are formed on a semiconductor substrate 80, such as a silicon substrate, through integrated-circuit manufacturing processes using microfabrication techniques, such as, film-forming and pattern-etching techniques. A liquid crystal 84 is filled between the semiconductor substrate 80 and a glass substrate 82.

Simultaneously produced in the manufacturing processes and embedded in the semiconductor substrate 80 is the temperature sensor 57 disclosed above, such as a PN-junction thermocouple, for monitoring the temperature of the liquid crystal 84.

The semiconductor substrate 80 is fixed on a reinforcing plate 86 made of an alloy, such as, Kovar or Fe—Ni alloy, for reinforcing the substrate 80. Such alloy-made reinforcing plate decreases the difference in coefficient of thermal expansion between the silicon-made substrate 80 and the plate 86 to minimize errors in three-panel alignments. The reinforcing plate 86 may also be made of a material with high thermal conductivity, such as, copper or aluminum.

Provided under the liquid-crystal display unit 56 is the cooling unit 59, one of the features of the present invention. The cooling unit 59 is equipped with a cooling jacket 88 directly attached to the lower surface of the reinforcing plate 86, having an inlet 88A and an outlet 88B connected to a refrigerant pipe 90. Provided along the pipe 90 are a compact circulating pump 92 and a compact heat exchanger 93 for cooling and circulating a refrigerant, such as coolant water or ethylene glycol, into the cooling jacket 88.

The temperature monitored by the temperature sensor 57 is sent to a controller 61, such as a microcomputer, for controlling the power of the circulating pump 92 and the heat exchanger 93 so that the temperature of the liquid crystal 84 stays at a given constant temperature.

Disclosed next is the operation of the third embodiment of the active-matrix display shown in FIG. 10.

Figure 13:
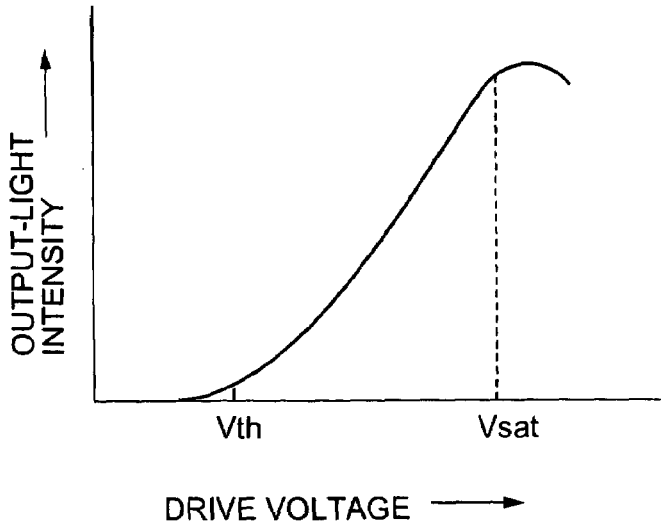
FIG. 13 shows the output-light intensity against liquid-crystal driving voltages.

An input analog video signal is converted into, for example, an 8-bit digital signal by the A/D converter 58. The input analog video signal is usually based on CRT reverse-gamma characteristics, thus exhibiting S-shaped output-light intensity v. s. liquid-crystal driving voltage characteristics, such as shown in FIG. 13, hence providing inaccurate gradation. In FIG. 13, the signs "Vth" and "Vsat" indicate a threshold voltage and a saturation voltage, respectively.

The third embodiment employs a look-up table, such as shown in FIG. 11, listing gradation levels and subfields, for adjustments to a subfield period and on-off control for each subfield, to provide accurate gradation (by gamma correction) and protection against pseudo-edge noises.

Listed in the look-up table are 256 gradation levels giving "1" for the subfields during which the liquid crystal display is turned on. The signs "1" are given only at several gradation levels in FIG. 11 for brevity. Display is performed in time series from a subfield SF1 to a sub-field SF19.

The 19 subfields SF1, SF2, SF3, . . . , and SF19 are aligned such that the subfield period is the shortest for the first subfield SF1 (30 microseconds) and gradually made longer towards the last subfield SF19 having the longest (305 microseconds).

The difference in subfield period between successive subfields is equal to one other per given number of subfields and becomes shorter as the subfield period becomes longer. In detail, the difference in subfield period between successive subfields is 30 microseconds for the shorter subfield periods, which, however, be shorter, such as 20 microseconds, 15 microseconds, 10 microseconds and then 5 microseconds, as the subfield period becomes longer.

In FIG. 11, the differences in subfield period between successive subfields are: 30 microseconds from the subfields SF1 to SF3; 20 microseconds from the subfields SF3 to SF8; 15 microseconds from the subfields SF8 to SF12; 10 microseconds from the subfields SF12 to SF16; and 5 microseconds from the subfields SF16 to SF19.

Moreover, in FIG. 11, as shown in the range from gradation level 21 to 36, as the level becomes higher, the subfields which are turned on ("1"), or for which the liquid crystal display is turned on, are shifted from the subfield having the shortest subfield period by one subfield towards the subfield having the longest subfield period. And, also, in the range from gradation level 21 to 36, when the subfield having the longest subfield period is turned on at a certain gradation level among those which have been turned off, the subfield having the longest subfield period is continuously turned on at gradation levels higher than the certain gradation level. Although not shown, the arrangements are made repeatedly at the gradation levels higher than the level 37. For example, the sub-field SF17 is on ("1") at the gradation level 20 and higher, and the sub-field SF16 is on ("1") at the gradation level 36 and higher.

Furthermore, in FIG. 11, as shown in the range from gradation level 1 to 10, the subfield which is turned on ("1") at a lower gradation level is shifted by two subfields or more from the subfield having the shortest subfield period towards that having the longest subfield period, and the subfield having the longest subfield period which is on ("1") at a certain gradation level is continuously turned on at gradation levels higher than the certain gradation level. For example, the subfield SF19 is on ("1") at the gradation level 2 and higher, and the sub-field SF18 is on ("1") at the gradation level 6 and higher (the sign "1" being omitted at levels 7 to 9 and levels 11 to 19 for brevity).

In FIG. 10, when the digital video signal is supplied, the subfield converter 60 converts its pixel signal corresponding to each pixel into a 19-bit subfield signal having a predetermined subfield period for a subfield. In detail, the subfield converter 60 accesses the look-up table, such as shown in FIG. 11, stored in the look-up memory 62 to divide the digital video signal into a given number of subfields, 19 subfields in this embodiment.

Physical addresses are appointed when an external write-control address signal is supplied to the subfield converter 60. Data stored in the look-up table of the look-up memory 62 are then written in the first and second frame memories 64 and 66 at the appointed physical addresses. The first and second frame memories 64 and 66 consist of 19 subfield memories (not shown), corresponding to the 19 subfields, to store subfield data for 640×480 pixels Px, for example.

The data stored in the subfield memories are read, for example per 32 bits, and stored in the shift registers SR1 to SR 20.

Data of 640 bits on the display panel 70 correspond to one column of pixels. After stored in the shift registers SR1 to SR 20, the data are transferred to memories (not shown), such as a flip-flop, of the first column of pixels. Data transfer is continued for the second, the third, . . . , and the 480th column of pixels Px for one subfield. On completion of data transfer for the first subfield and data storage in the memories of all the columns of pixels, liquid-crystal driving voltages are simultaneously applied to all the pixels in accordance with the data stored in the memories of all the columns of pixels, to simultaneously drive the liquid crystals of all the pixels.

The same operation is continued for the second, the third, . . . , and the 19th subfield to complete displaying for one field.

While data are read out from the first frame memory 64, other data are written in the second frame memory 66 from the subfield converter 60. On completion of data read from the first frame memory 64 for one field, other one-field data are read from the second frame memory 66. Thereafter, write and read operations in and from the first and second frame memories 64 and 66 are alternately performed per field.

As disclosed above, in the look-up table shown in FIG. 13, the subfield period becomes longer as the number of the subfields increases. The difference in subfield period between successive subfields is 30 microseconds for the subfields having shorter subfield period (subfields SF1 to SF3), which is, however, shorter as 20 microseconds, 15 microseconds, 10 microseconds and 5 microseconds, as the subfield period becomes longer.

The difference in subfield period in this embodiment is made from the fact that, as shown in FIG. 13, the intensity of output light varies like S-shaped not linearly against the drive voltage (root-mean-square value) to the liquid crystal, thus, even if the total of subfield periods for several subfields is equal to a subfield period of a particular subfield, the output light is brighter for this particular subfield than the several subfields. Therefore, the subfield period is required to be shorter as the number of subfields increases, for offering accurate gradation.

All the subfields are turned off at the gradation level 0, the reference for deciding the black level on the liquid crystal display. Based on the gradation level 0, each subfield is turned on or off for a required black level.

As shown in FIG. 13, the output-light intensity exhibits S-shaped characteristics against liquid-crystal driving voltage (root-mean-square value). This characteristics makes the subfields to be selectively turned on, as follows:

At the gradation level 1, a subfield having a relatively long subfield period, such as the subfield SR9, is turned on.

At the gradation level 2 and higher, the subfield SR19 having the longest subfield period is turned on.

At higher gradation levels 3, 4, 5, . . . , the subfield to be turned on is shifted by a given number of subfields, such as, 4 subfields, from the subfields having shorter subfield period to those having longer subfield period. For example, In FIG. 11, the subfield SF4 is turned on at the gradation level 3, the subfield SF9 is on at the gradation level 4, and the subfield SF14 is on at the gradation level 5.

The number of subfields to be shifted is large, such as 4 subfields, as explained above, at lower successive gradation levels closer to the level (pure black), which is, however, not bright and hence not observed as pseudo edge noises.

As disclosed above, the third embodiment employs the look-up table, such as shown in FIG. 11, in which the center of emission is shifted a little even if the gradation level varies, thus efficiently restricting the generation of pseudo edge noises. Moreover, the subfield period is made longer in accordance with the order of subfields to be turned on in the look-up table, such as shown in FIG. 11, thus a displayed moving picture is protected from blurring which could, otherwise, be blurred due to decrease in resolution of the picture when it moves even though resolution is high when it stays.

Employed in this embodiment is a driving sequence having a pattern in which the liquid crystal display is tuned into bright once in one field. Another feasible driving sequence has a pattern in which the liquid crystal display is turned into bright twice or more in one field, which generates little flickers.

As discussed, when the temperature of the liquid crystal 84 of the display unit 56 (FIG. 12) rises, the gamma characteristics varies due to change in viscosity of the liquid crystal 84, and hence brightness also varies to lower the image quality.

To solve such problems, in the third embodiment, the temperature of the liquid crystal 84 is monitored by the temperature sensor 57 provided in the vicinity of the liquid crystal 84. In response to the monitored temperature, the controller 61 controls the cooling unit 59 so that the temperature of the liquid crystal 84 stays at a given constant temperature. In detail, the heat generated at the display unit 56 is cooled down by the refrigerant flown through the cooling jacket 88 so that the temperature of the liquid crystal 84 stays at a given constant temperature, thus high image quality being achieved all time.

The controller 61 controls the circulating pump 92 to adjust the amount of refrigerant to be circulated in the cooling jacket 88 or the heat exchanger 93 to adjust the amount of heat to control the temperature of the liquid crystal 84.

The semiconductor substrate 80 made of silicon exhibits high thermal conductivity, thus not provide a temperature distribution in the in-plane direction on the substrate, hence effective cooling achieved over the substrate surface through the cooling jacket 88.

The temperature sensor 57, such as a PN-junction thermocouple, can be simultaneously produced in the manufacturing processes for the display unit 56, thus the present invention being applicable with little increase in the manufacturing processes.

The temperature of the liquid crystal 84 can be most accurately monitored by the temperature sensor 57 when the sensor is embedded in the semiconductor substrate 80 and closer to the pixels but far from the source of heat generation such as the drivers.

The temperature to which the liquid crystal 84 to be cooled down is in the range from, such as 30 to 40° C. little bit higher than the room temperature at which the liquid crystal display is used. An actual allowable temperature range depends on several factors such as, the viscosity characteristics of the liquid crystal 84 against temperature and drive voltages to be applied to the liquid crystal 84.

The cooing unit 59 in the third embodiment is equipped with the cooling jacket 88 as shown in FIG. 12. Not only that, a cooling mechanism illustrated in FIG. 14 is also feasible.

Figure 14:
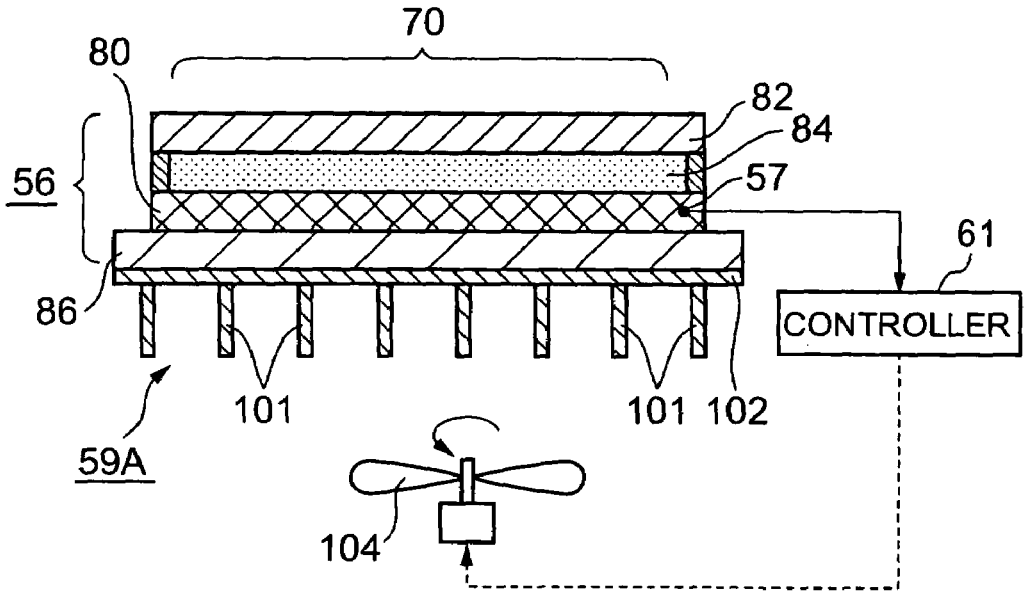
FIG. 14 shows a modification to the cooling mechanism in the third embodiment of the active-matrix display according to the present invention.

A cooling unit 59A shown in FIG. 14, as a modification to the cooling unit 59, is equipped with a cooling plate 102 having several metallic cooling fans 101, attached to the reinforcing plate 86. Provided under the cooling unit 59A is a cooling fan 104 that is controlled by the controller 61 to cool the liquid crystal 84.

A heat exchanging element, such as a peltier device, can be provided between the reinforcing plate 86 and the cooling plate 102 for enhanced cooling efficiency.

Fourth Embodiment

Disclosed next is a fourth embodiment of a liquid crystal display according to the present invention.

The embodiments disclosed above employ one liquid crystal display unit in each liquid crystal display. Not only that, the present invention is applicable to a color liquid crystal display having three liquid crystal display units for red (R), green (G) and blue (B).

Figure 15:
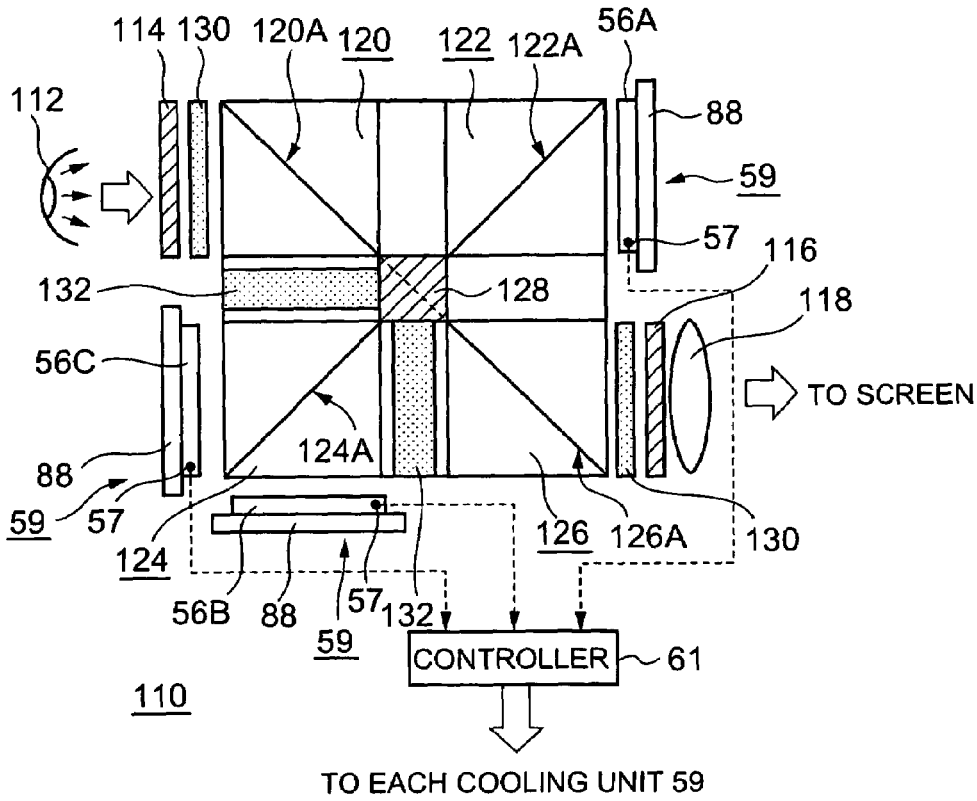
FIG. 15 shows the major section (light-modulation optical package) of a color liquid crystal display, as a fourth embodiment according to the present invention.

Illustrated in FIG. 15 is the major section (light-modulation optical package) of a color liquid crystal display having spatial light modulators as liquid crystal display units, as the fourth embodiment according to the present invention.

Provided at a light-emitting side of a light-modulation optical package 110 is a light source 112 for emitting a non-linearly-polarized white light and a first polarizer 114 for selectively allowing a specific-linear-polarized light component of the white light to pass therethrough.

Provided at a light-emitting side of the light-modulation optical package 110 is a second polarizer 116 for selectively allowing a specific-linearly-polarized light to pass therethrough and a projection lens 118.

A specific-linearly-polarized light emitted from the polarizer 116 is projected onto a screen (not shown) for displaying a color image via the projection lens 118.

The light-modulation optical package 110 is equipped with cubic- or square column-like first to fourth polarization beam splitters 120, 122, 124 and 126 having polarization-splitting planes 120A, 122A, 124A and 126A, respectively, intersecting each other like a character-"X", bonded to each other on a ceramic base.

A light blockage 128 is provided at the center of the light-modulation optical package 110.

The first polarization beam splitter 120 is a light-incident side beam splitter whereas the fourth polarization beam splitter 126 is a light-emitting side beam splitter. Provided at the light-mitting side of the first polarization beam splitter 120 and also the light-emitting side of the fourth polarization beam splitter 126 are wavelength-selective polarizing converters (for example, G-phase plates) 130 for rotating the plane of polarization of, for example, a G-linearly-polarized light, by 90 degrees. Provided between the first polarization beam splitter 120 and the third polarization beam splitter 124, and also between the third polarization beam splitter 124 and the fourth polarization beam splitter 126 are wavelength-selective polarizing converters (for example, R-phase plates) 132 for rotating the plane of polarization of, for example, a R-linearly-polarized light, by 90 degrees.

Provided as facing the light-passing planes of the second and the third beam splitters 122 and 124 are reflective spatial light modulators (reflective display units) 56A, 56B and 56C for color G, R and B, respectively. Each spatial light modulator is equipped with the temperature sensor 57 and attached on the cooling unit 59, like the third embodiment.

The temperature control is performed by the controller 61, like the third embodiment., for each color. Three controllers may be provided for three colors.

In this type of color liquid crystal display, change in output of R, G and B appears on screen as change in color which is easily observed by users. Thus, such a color liquid crystal display requires fine control against change in viscosity of liquid crystals due to change in temperature.

To fulfill the requirements, the fourth embodiment employs the following three modes of temperature control to the reflective spatial light modulators 56A, 56B and 56C:

(1) Adjust the temperature of the reflective spatial light modulators 56A, 56B and 56C to a given constant temperature, such as, about 35° C. or within a given constant range with no relation to the room temperature at which the liquid crystal display is used.

(2) Adjust the temperature of the reflective spatial light modulators 56A, 56B and 56C, separately, to respective constant temperatures or within respective constant ranges with no relation to the room temperature at which the liquid crystal display is used. This temperature control at different temperatures for the three reflective spatial light modulators compensates for difference in rate of temperature rise due to difference in amount of light absorbed by the three light modulators for the colors R, G and B. Temperature rise could differ by 2 or 3° C. to 10° C. for the three light modulators, if not cooled. In this control mode (2), for example, the temperature of the reflective spatial light modulator 56A for the color G exhibiting the highest rate of temperature rise is adjusted to about 40° C., the modulator 56B for the color R exhibiting the intermediate rate of temperature rise to about 35° C., and the modulator 56C for the color B exhibiting the lowest rate of temperature rise to about to 30° C.

Figure 16:
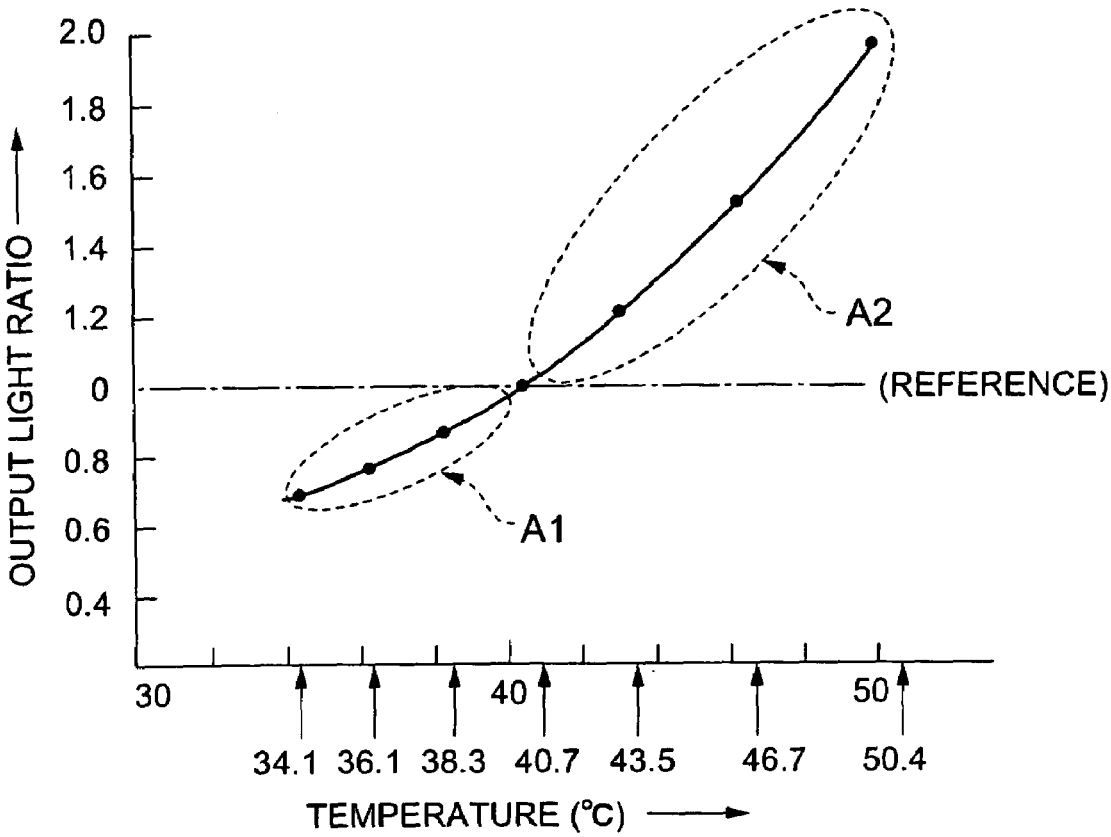
FIG. 16 shows the dependency of output light ratio on temperature at a gradation level 75.

(3) Adjust the temperature of the reflective spatial light modulators 56A, 56B and 56C, separately, to achieve the least color change in accordance with the room temperature at which the liquid crystal display is used. Shown in FIG. 16 is the dependency of the output light ratio on temperature at the gradation level 75 (FIG. 1) based on the reference temperature 40.7° C. FIG. 16 indicates that change in the output light ratio is small in a low-temperature zone A1 whereas large in a high-temperature zone A2. Thus, in this control mode (3), moderate temperature control is performed in the low-temperature zone A1 for low dependency of the output light ratio on temperature within a specific temperature range, such as ±5° C., against a set temperature whereas fine temperature control in the high-temperature zone A2 for high dependency of the output light ratio on temperature within a specific temperature range, such as ±2° C., against a set temperature.

As disclosed, the fourth embodiment consumes less power in temperature control while achieving high image quality. The fourth embodiment shown in FIG. 15 is a projection-type liquid crystal display, however, the present invention is applicable to other types of liquid crystal display.

As disclosed above in detail, the liquid crystal display according to the present invention can compensate for change in temperature-dependent gamma characteristics of liquid crystals, thus offering accurate gradations and achieving high image quality independent of temperature change.

What is claimed is:

1. A liquid crystal display including a liquid-crystal display unit having a matrix of multiple pixels comprising:

a divider to divide a field of a digital input video signal to be supplied to the liquid-crystal display unit into a plurality of subfields; and an adjuster to adjust a voltage of the digital video signal per subfield to compensate for change in gamma characteristics of the liquid-crystal display unit.

2. The liquid crystal display according to claim 1 further comprising a producer to produce a first pulse signal in accordance with periods of the subfields and a second pulse signal in accordance with the video signal, and superimpose the second pulse signal on the first pulse signal, thus producing the digital video signal.

3. The liquid crystal display according to claim 2, wherein the second pulse signal is smaller than the first pulse signal.

4. The liquid crystal display according to claim 2, wherein the adjuster adjusts a voltage of the first pulse signal while keeping a voltage of the second pulse signal at a given constant level.

5. The liquid crystal display according to claim 2, wherein the adjuster adjusts a voltage of the second pulse signal while keeping a voltage of the first pulse signal at a given constant level.

6. The liquid crystal display according to claim 1 further comprising a detector to detect a temperature of the liquid-crystal display unit, the adjuster adjusting the voltage of the digital video signal per subfield in accordance with the detected temperature to compensate for a temperature-dependent change in the gamma characteristics of the liquid-crystal display unit.

7. The liquid crystal display according to claim 6 further comprising a memory storing compensation data, based on change in the temperature of the liquid-crystal display unit, for compensating for the temperature-dependent change in the gamma characteristics of the liquid-crystal display unit, the adjuster accessing the compensation data and adjusting the voltage of the digital video signal based on the compensation data.

8. The liquid crystal display according to claim 6, wherein the detector is provided as embedded in a semiconductor substrate on which the liquid-crystal display unit is assembled.

9. A liquid crystal display including a liquid-crystal display unit having a matrix of multiple pixels comprising:

a divider to divide a digital video signal to be supplied to the liquid-crystal display unit into a plurality of subfields; and an adjuster to adjust a period of at least one subfield of the video signal to compensate for change in gamma characteristics of the liquid-crystal display unit.

10. The liquid crystal display according to claim 9, wherein the adjuster adjusts the longest period of one subfield of the video signal in accordance with the detected temperature.

11. The liquid crystal display according to claim 9 further comprising a detector to detect a temperature of the liquid-crystal display unit; the adjuster adjusting the period of at least one subfield of the video signal in accordance with the detected temperature to compensate for a temperature-dependent change in the gamma characteristics of the liquid-crystal display unit.

12. The liquid crystal display according to claim 11 further comprising a memory storing compensation data, based on change in temperature of the liquid-crystal display unit, for compensating for the temperature-dependent change in the gamma characteristics of the liquid-crystal display unit, the adjuster accessing the compensation data and adjusting the period of the subfield of the video signal based on the compensation data.

13. The liquid crystal display according to claim 11, wherein the detector is provided as embedded in a semiconductor substrate on which the liquid-crystal display unit is assembled.

14. A method of driving a liquid crystal display including a liquid-crystal display unit having a matrix of multiple pixels comprising the step of:

dividing a field of a digital input video signal to be supplied to the steps of: liquid-crystal display unit into a plurality of subfields; and adjusting a voltage of the digital video signal per subfield to compensate for change in gamma characteristics of the liquid-crystal display unit.

15. The method of driving a liquid crystal display according to claim 14 further comprising the steps of:

producing a first pulse signal in accordance with periods of the subfields and a second pulse signal in accordance with the video signal; and superimposing the second pulse signal on the first pulse signal, thus producing the digital video signal.

16. The method of driving a liquid crystal display according to claim 15, wherein the second pulse signal is smaller than the first pulse signal.

17. The method of driving a liquid crystal display according to claim 15, wherein the adjusting step includes the step of adjusting a voltage of the first pulse signal while keeping a voltage of the second pulse signal at a given constant level.

18. The method of driving a liquid crystal display according to claim 15, wherein the adjusting step includes the step of adjusting a voltage of the second pulse signal while keeping a voltage of the first pulse signal at a given constant level.

19. The method of driving a liquid crystal display according to claim 14, further comprising the step of detecting a temperature of the liquid-crystal display unit, the adjusting step including the step of adjusting the voltage of the digital video signal per subfield in accordance with the detected temperature to compensate for a temperature-dependent change in the gamma characteristics of the liquid-crystal display unit.

20. The method of driving a liquid crystal display according to claim 19, wherein the adjusting step includes the step of accessing compensation data, based on change in the temperature of the liquid-crystal display unit, for compensating for the temperature-dependent change in the gamma characteristics of the liquid-crystal display unit, thus, adjusting the voltage of the digital video signal based on the compensation data.

21. A method of driving a liquid crystal display including a liquid-crystal display unit having a matrix of multiple pixels comprising the steps of:

dividing a field of a digital input video signal to be supplied to the liquid-crystal display unit into a plurality of subfields; and adjusting a period of at least one subfield of the video signal to compensate for change in gamma characteristics of the liquid-crystal display unit.

22. The method of driving a liquid crystal display according to claim 21, wherein the adjusting step includes the step of adjusting the longest period of one subfield of the video signal in accordance with the detected temperature.

23. The method of driving a liquid crystal display according to claim 21 further comprising the step of detecting a temperature of the liquid-crystal display unit, the adjusting step including the step of adjusting the period of at least one subfield of the video signal in accordance with the detected temperature to compensate for a temperature-dependent change in the gamma characteristics of the liquid-crystal display unit.

24. The method of driving a liquid crystal display according to claim 23, wherein the adjusting step includes the step of accessing compensation data, based on change in temperature of the liquid-crystal display unit, for compensating for the temperature-dependent change in the gamma characteristics of the liquid-crystal display unit, thus accessing the compensation data and adjusting the period of the subfield of the video signal based on the compensation data.

* * * * *